US005673614A

United States Patent [19]

Jaenson et al.

[11] Patent Number: 5,673,614

[45] Date of Patent: Oct. 7, 1997

[54] WIRE TYING DEVICE

[75] Inventors: Howard W. Jaenson, Covina; Bradley P. Actis, Rancho Cucamonga, both of Calif.

[73] Assignee: H.W.J. Designs for Agribusiness, Covina, Calif.

[21] Appl. No.: 602,495

[22] Filed: Feb. 20, 1996

[51] Int. Cl.[6] ..... B65B 13/24

[52] U.S. Cl. ..... 100/8; 100/3; 100/29; 100/34

[58] Field of Search ..... 100/3, 8, 11, 16, 100/25, 26, 29, 33 R, 34; 140/93 A, 101, 111

[56] References Cited

U.S. PATENT DOCUMENTS

| | | | |
|---|---|---|---|
| Re. 26,289 | 10/1967 | Neitzel et al. | 100/4 |
| 321,542 | 7/1885 | Sheppard | 100/29 |
| 1,732,619 | 10/1929 | Ryan . | |
| 1,947,918 | 2/1934 | Paxton . | |
| 2,612,833 | 10/1952 | MacChesney | 100/2 |
| 2,937,484 | 5/1960 | Wiman . | |
| 3,168,912 | 2/1965 | Marica | 140/101 |
| 3,213,780 | 10/1965 | Nietzel et al. | 100/4 |
| 3,279,355 | 10/1966 | Missioux | 100/26 |
| 3,477,363 | 11/1969 | Trumbo | 100/34 |
| 3,767,885 | 10/1973 | Fryer | 219/56 |
| 3,863,297 | 2/1975 | Simich | 24/27 |
| 3,863,558 | 2/1975 | Trumbo | 100/34 |
| 4,055,115 | 10/1977 | Simich et al. | 100/34 |
| 4,353,295 | 10/1982 | Kandarian | 100/8 |
| 4,484,518 | 11/1984 | Jaenson | 100/4 |
| 5,546,855 | 8/1996 | Van Doorn et al. | 100/33 R |

*Primary Examiner*—Stephen F. Gerrity
*Attorney, Agent, or Firm*—Christie, Parker & Hale, LLP

[57] ABSTRACT

A tying device is provided for mounting on a baling press for tying a plurality of wires having preformed interlocking ends around a bale formed in the press. The device includes a center plate mounted above the press chamber in which the bale is formed and a pair of wire bend assemblies pivotally mounted on opposite sides of the center plate. The wire closer assembly is mounted on the press ram below the bale and provides the floor of the baling chamber. The wire bend assemblies pivot from a fully raised to a fully lowered position to bend the preformed interlocking ends of the wires around the bale and to insert the interlocking ends into the wire closer assembly where the interlocking ends terminate in loops oriented in a vertical plane. The wire bend assemblies include guide rollers for guiding the interlocking ends of the wire into the wire closer assembly while the press ram is in its last few inches of travel to compress the bale.

14 Claims, 15 Drawing Sheets

12
10
64
28
40
18
116a
20
110
116
106
24
96
86
80
112
114
22
70
74
68b
26
22a
108
38
84
168
172
170
32
16

WIRE TYING DEVICE

FIELD OF THE INVENTION

The invention relates to an apparatus and method useful for tying a plurality of wires with pre-formed interlocking ends around a bale.

BACKGROUND OF THE INVENTION

In the cotton industry, the normal method of banding or tying cotton bales has been to have workmen direct a tie, such as a band or wire, around a bale and then secure the ends of the tie as appropriate depending on the design of the tie.

A manual-type bale-tying operation is described in U.S. Pat. No. 3,477,363 to Trumbo, the disclosure of which is expressly incorporated herein by reference.

Trumbo discloses that a bale, such as a bale of cotton, can be tied using a plurality of wires that have interlocking ends pre-formed into loops. In such a bale-tying operation, two workmen are normally required (one on each side of the baling press) to bend the wires around the bale and to secure the ends of the wires together in a wire tie guide assembly. The wires are normally tied together one at a time.

Since a plurality of wires are required to properly secure a cotton bale, e.g., a "universal density" cotton bale requires eight wires, a manual-type bale-tying process can take a substantial amount of time.

The amount of time it takes to tie a cotton bale is important since the process of pressing the next bale cannot begin until the preceding bale has been tied and removed from the press.

An automatic-type bale-tying apparatus is described in U.S. Pat. No. 4,484,518 to Jaenson, the disclosure of which is expressly incorporated herein by reference.

Jaenson discloses a hydraulically operated wire tying device for mounting on a baling press for tying a plurality of wires having pre-formed interlocking ends around a bale formed in the press. Pivotally mounted wire bend assemblies take the place of workmen on each side of the baling press for bending the tie wires around a bale and inserting the ends of the tie wires into a wire tie guide assembly.

A follow block, which is connected to and driven by the press ram below the bale, forms the floor of the baling chamber and includes a wire closer assembly. The wire bend assemblies pivot from a fully raised to a fully lowered position to bend the pre-formed interlocking ends of the wire around the bale and insert the interlocking ends into the wire closer assembly where the interlocking ends are joined together to form a knot.

Although an improvement over the manual-type of bale-tying operation, Jaenson's hydraulically operated wire tying device still exhibits some problems which slow the ginning process. Exact timing is required for the sequence of events which makes up a wire tying operation. If a wire does not follow the correct path at the correct time, several factors can prevent the interlocking ends of the wire from engaging in a knot. The tip of the front wire can extend up through the exit hole in the cover plate, or, if cotton is pressed into the exit hole, the cotton can deflect the tip of the wire as it enters the tie cavity, altering its course.

Furthermore, the interlocking ends of the wires are oriented such that the loops are disposed in a generally horizontal plane. This geometric orientation causes the wire closers to be constructed with relatively wide cavities, to accommodate the wide aspect of the loops, which, in turn, allows the wires a greater freedom of movement within the cavities. Consequently, there is a greater probability of one wire merely sliding past another, without their loops engaging in a knot. Even were the loops to engage properly, if the resulting knot were not properly positioned beneath an exit port (provided for such purpose on the follow block), the knot would "catch" on the follow block and the bale would not be able to be released from the press.

In addition, press wear, both alone or in combination with component manufacturing tolerances, can cause the follow block to vary its position or orientation both vertically and from side to side. Consequently, the wire bend assemblies may not be in alignment with the wire tie guide assemblies. All the above-described cases result in miss-ties, with a consequent loss of time, and could result in damage to the press.

As cotton gins become larger and new high speed production equipment is used, it is important to press, tie, and eject the bales quickly. In particular, an apparatus (and process) for tying bales, that is designed for efficient, error free operation is needed. Such an apparatus should be designed for easy operation by one workman to reduce labor costs, while at the same time increasing the ginning speed by incorporating the tying process into the last few seconds of the bale pressing operation, thus eliminating the separate wire tying step at the end of the process.

SUMMARY OF THE INVENTION

In accordance with this invention, a bale-tying device is provided for mounting on a bale press. The tying device can be operated by a single workman for tying a plurality of wires having preformed interlocking ends around a bale formed in the press. The tying device operates to tie the plurality of wires around the bale while the press ram is in its last few inches of compression motion. Thus, in accordance with the invention, the pressing operation and the tying operation are completed substantially at the same time.

The tying device comprises a first wire bend assembly pivotally mounted on one side of the baling press for holding and bending the first pre-formed interlocking end of a wire downwardly around one side of the bale as the assembly pivots from its fully raised to its fully lowered position. A second wire bend assembly is pivotally mounted on the opposite side of the baling press for holding and bending the second pre-formed interlocking end of the wire downwardly around the opposite side of the bale as the assembly pivots from its fully raised to its fully lowered position. The wire tying device additionally comprises a follow block mounted on the press having a top surface which forms the floor of the chamber in which the bale is formed and against which the bale is compressed, and a wire closer, in which the first interlocking end of the wire is held by the first wire bend assembly as the second interlocking end of the wire is moved by the second wire bend assembly into interlocking engagement with the first end. Guide means are provided for guiding the first interlocking end of the wire into position in the wire closer and for guiding the second interlocking end of the wire into interlocking engagement with the first end, the guide means further comprising means for preventing the first and second wire bend assemblies from pivoting to the fully lowered position unless the follow block has been raised to a predetermined position.

In one aspect of the invention, the wire closer comprises an elongated, open-ended cavity extending across the width of the closer, the first pre-formed interlocking end of the wire is inserted into the first open end of the cavity by the first wire bend assembly as the first assembly is pivoted downwardly, and the second interlocking end of the wire is inserted into a second open end of the cavity by the second wire bend assembly as the second assembly is pivoted downwardly.

Each of the wire closers comprise a cavity open on both ends for insertion of the opposite ends of the wires, each of the wire closers further comprising means for holding the first interlocking end of such a wire in proper position so that when the second pre-formed interlocking end of such a wire is inserted into the wire closer, such interlocking ends are joined together.

In another aspect of the invention, each wire bend assembly comprises an arm assembly mounted on a center plate capable of being pivoted downwardly from a fully raised position to a fully lowered position and which includes a finger assembly comprising a plurality of horizontally spaced-apart fingers each of which can be pivoted downwardly from a fully raised position to a fully lowered position, each such finger on the first wire bend assembly being associated with a counterpart finger on the second wire bend assembly, the wire bend assembly is constructed so that when both the arm assemblies and fingers comprising the first and second wire bend assemblies are in their fully raised positions, and the wires to be tied around the bale are positioned in the tying devices for tying, each such wire is held on one end by one of the fingers of the first wire bend assembly and extends across the baling press such that the second end of such wire is underneath the counterpart finger of the second wire bend assembly.

Each finger assembly further comprise guide means for guiding the first interlocking end of the wire into position in the wire closer cavity and for guiding the second interlocking end of the wire into interlocking engagement with the first end. The guide means operate in response to the motion of the wire closer assembly as it moves toward the center plate, thereby compressing the bale.

In yet another aspect of the invention, the guide means comprises a cam arm assembly coupled to the finger assembly and controls the angular position of the finger assembly. The cam arm assembly includes a cam roller for engaging the wire closer assembly, the cam roller entering a corresponding cavity in the wire closer assembly, thereby guiding the finger assembly fingers into the open ends of their corresponding cavities.

The guide means includes a stop arm coupled to the finger assembly which further includes a bumper for contacting the wire closer assembly when the wire closer assembly has not moved sufficiently toward the center plate so as to allow the finger assembly fingers to be inserted into the open ends of the wire closer cavities. The stop arm thus prevents the wire bend assemblies from being pivoted to their fully lowered position, unless the wire closer assembly is in a proper pre-determined position.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

Figures 1, 3:
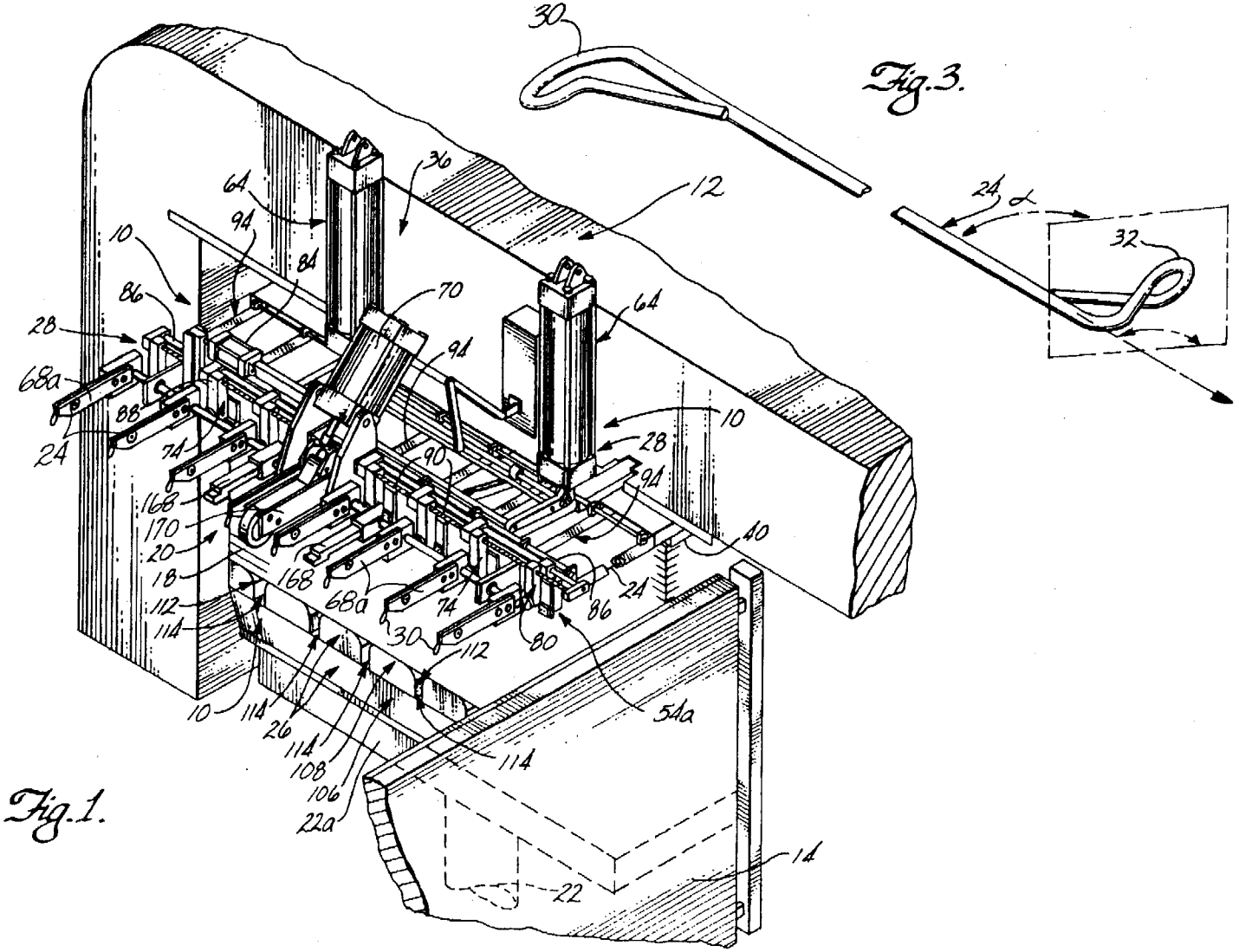
FIG. 1 is a semi-schematic perspective view of the operator's side of an exemplary embodiment of a wire-tying device provided in accordance with practice of principles of the invention which is mounted on a baling press for tying a plurality of wires around a bale formed in the press.
FIG. 3 is a fragmentary perspective view of a wire having first and second interlocking ends formed into loops that can be used by the wire-tying device of the invention for tying around a bale.
Figure 2:
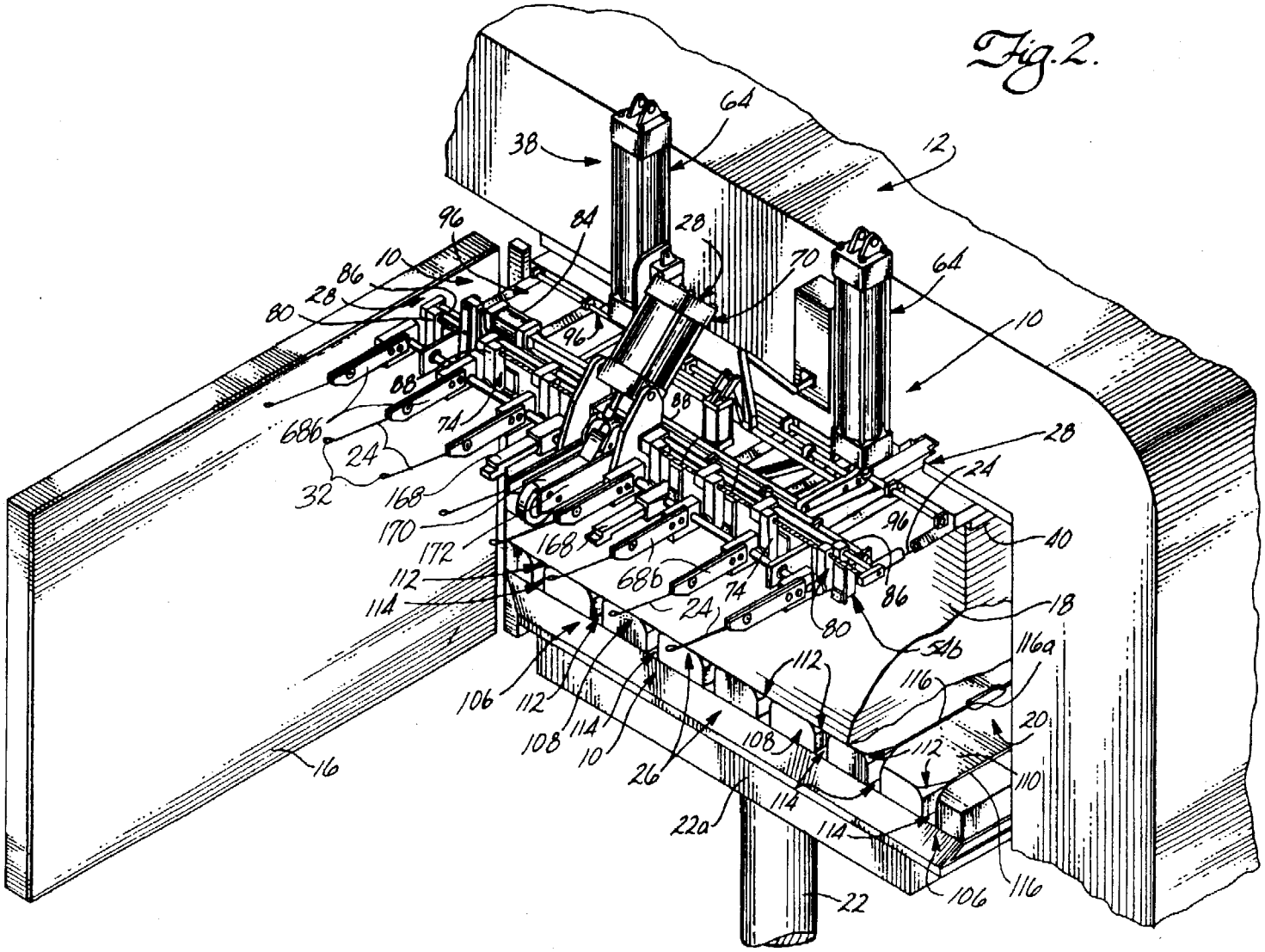
FIG. 2 is a semi-schematic perspective view of the opposite or unattended side of the wire-tying device of FIG. 1.

Referring to FIGS. 1 and 2, there are shown semi-schematic perspective views of the front side and back side, respectively, of a working embodiment of a wire-tying device 10, provided in accordance with this invention, mounted on a typical cotton baling press 12.

The press 12 is shown with its front and back doors 14 and 16, respectively, open to provide access for tying a bale 18 compressed in the baling chamber 20 by means of a ram 22.

As is described below in greater detail, the tying device 10 (which is shown in FIGS. 1 and 2 in its fully raised position) is useful for tying eight wires 24 around a bale, such as the bale 18, after the bale has been formed in the baling chamber 20 and the press doors 14 and 16 are opened. If desired, the device 10, provided in accordance with this invention, can be modified to tie more or fewer wires than eight.

Although the tying device 10 is described with particular reference to a cotton baling operation, it can be used for tying bales of other materials as well.

A key feature of the tying device 10, provided in accordance with this invention, is that it is designed to be loaded with tie wires and operated from the front side of the press by a single workman. Since only one workman is required, and that workman need not travel back and forth from the front to the back of the press, the bale-tying operation performed by the tying device 10 is economical. For purposes of exposition herein, the front side of the tying device (shown in FIG. 1) is called the "operator side", and the back side (shown in FIG. 2) is called the "unattended side".

The tying device 10 comprises two separate assemblies which operate together to automatically tie the plurality of wires 24 around the bale 18. The first, or lower assembly is a follow block structure 26 which, as is described below in greater detail, is uniquely constructed in accordance with this invention, and which rides below the bale on the ram head 22*a*. The second, or upper assembly 28 is mounted on the baling press above the baling chamber 20 for bending the plurality of wires 24 around the bale and for inserting the opposed ends of the wires into the follow block where they are joined together.

Referring to FIG. 3, it can be understood that each of the wires 24 to be tied around the bale 18 has a first pre-formed interlocking end or loop 30 on the operator side of the tying device (shown in FIG. 1) and a second pre-formed interlocking end or loop 32 on the unattended side of the tying device (shown in FIG. 2). As is described in greater detail below, the first and second interlocking ends 30 and 32 of each of the wires 24 are automatically joined together to form a knot in the unique follow block structure by the action of the upper assembly 28 on the wires. Additional details of wires useful in practice of this invention, and the manner in which the interlocking ends of such wires engage each other to form a knot, can be found in the aforementioned U.S. Pat. No. 3,477,363 to Trumbo.

As can be seen in FIG. 3, the wide (or diametric) dimension of each of the loops 30 and 32 lies in a plane which is substantially vertical when, as will be described further below, the wires 24 have been loaded into the tying device, in preparation for being tied around a bale. The vertical plane of each loop is bent away from the major axis of the wire such that the wire axis and the plane of the loops forms an obtuse angle $\alpha$.

Figure 4:
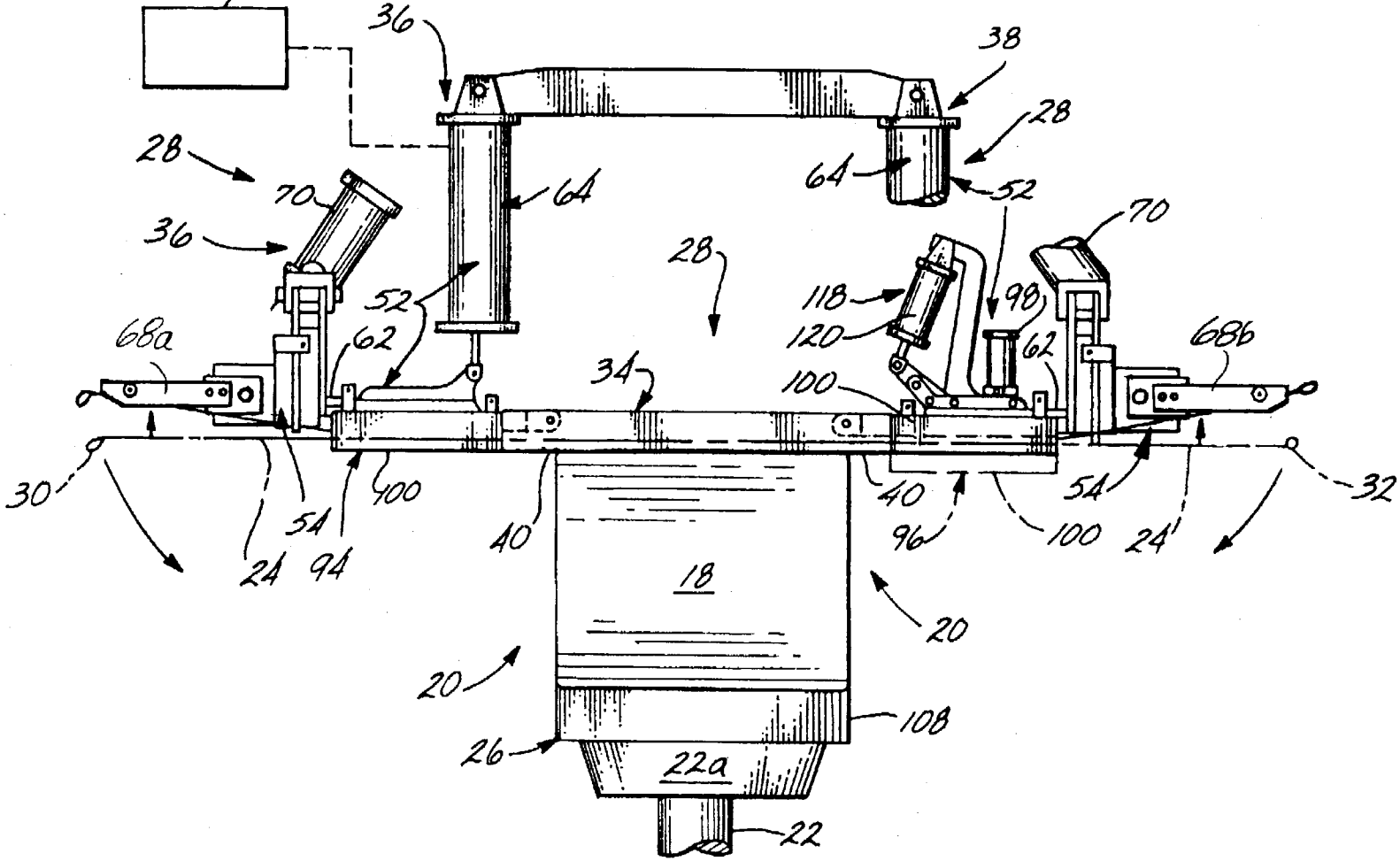
FIG. 4 is a semi-schematic, fragmentary side view of the wire-tying device of FIGS. 1 and 2, showing the wire-tying device in its loaded condition.

Referring to FIG. 4, in addition to FIGS. 1 and 2, it can be understood that the tying device upper assembly 28 includes three separate structures that are operably connected together; a center plate 34 fixedly mounted on the baling press and a pair of wire bend assemblies pivotally mounted on opposite sides of the center plate for upward and downward pivoting action. The first and second wire bend assemblies 36 and 38 are mounted on opposite sides of the center plate for upward and downward pivoting action. The first wire bend assembly 36 is mounted on the operator side of the press (shown in FIG. 1), and the second wire bend assembly 38 is mounted on the unattended side of the press (shown in FIG. 2).

Figure 5:
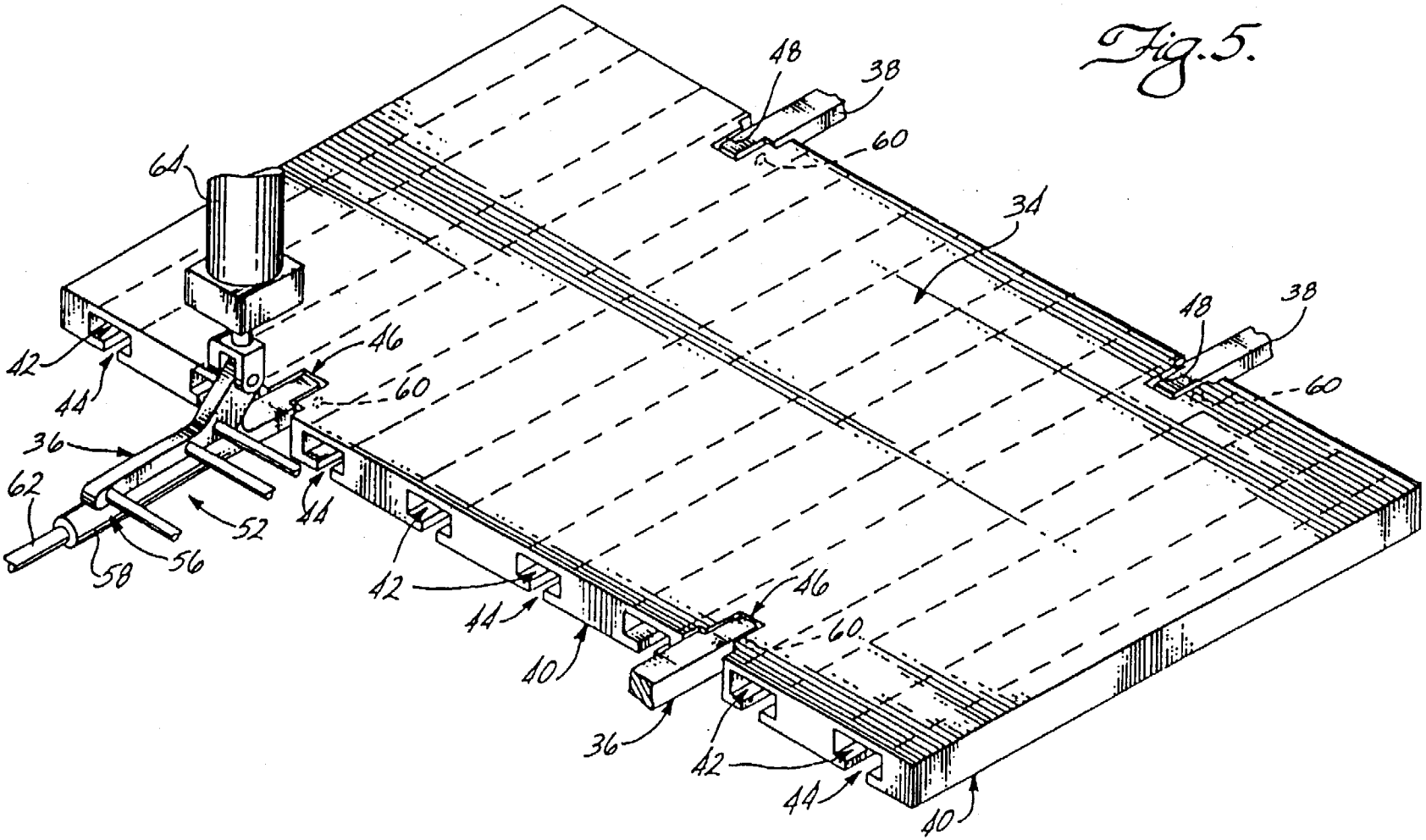
FIG. 5 is a semi-schematic perspective view of an exemplary embodiment of the center plate of the wire-tying device of FIGS. 1 and 2.

The bottom surface 40 of the center plate 34 forms the roof of the baling chamber 20 and provides one of the surfaces against which the bale 18 is compressed. Referring to FIG. 5, it can be understood that the center plate 34 has eight elongated, slotted channels 42 formed in its bottom surface 40. The channels 42 are open ended and extended from the front to the back side of the center plate 34 across its width. The wires 24 (not shown in FIG. 5), when loaded on the tying device 10, extend through the channels 42. The wires exit the channels through the channel slots 44 during the bale-tying operation so that the completed bale can be removed from the press.

A pair of horizontally spaced-apart recesses 46 is in the edge of the center plate 34 on the operator side of the press for pivotally mounting the first wire bend assembly 36. A pair of horizontally spaced-apart recesses 48 is in the opposite edge of the center plate for pivotally mounting the second wire bend assembly 38.

As can be best seen by referring to FIGS. 1, 2, and 4, both the first and second wire bend assemblies 36 and 38 are made up of two separate structures that are operably joined together; an inner or arm assembly 52 pivotally mounted on the center plate 34 and an outer or finger assembly 54 mounted on the arm assembly.

Figure 6:
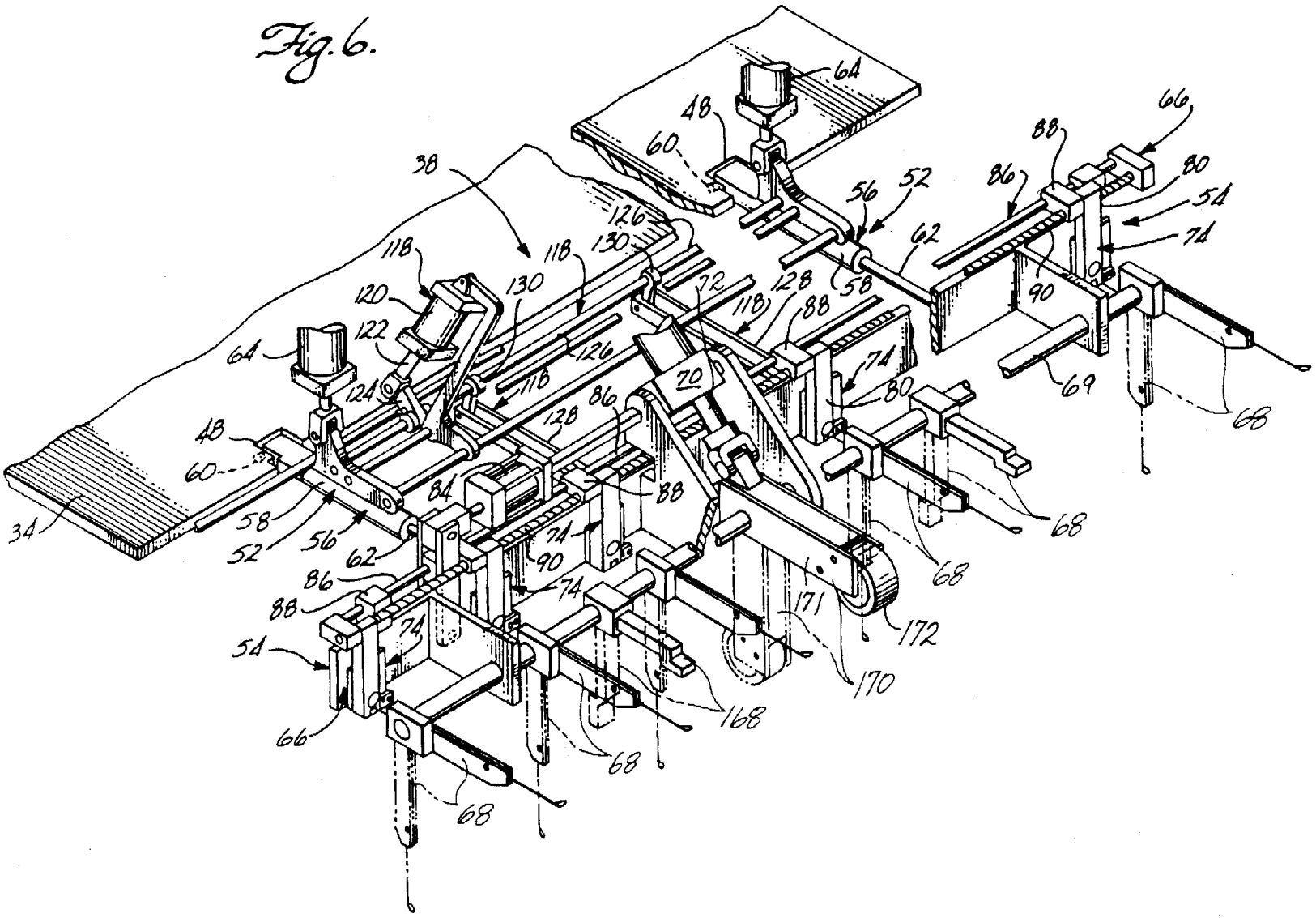
FIG. 6 is a semi-schematic, fragmentary perspective view of a wire bend assembly and center plate of the wire-tying device of FIGS. 1 and 2.

Referring to FIGS. 5 and 6, the construction of the arm assemblies 52, the connection between the arm assemblies and the center plate 34, and the connection between the arm assemblies and their associated finger assemblies, can be understood.

Each arm assembly 52 includes a pair of horizontally spaced-apart cylinder arms 56 connected between the center plate 34 and its associated finger assembly. Each cylinder arm 56 includes a cylinder 58 pivotally mounted at one end by means of a horizontal pivot 60 mounted in each center plate recess 46 (shown in FIG. 5 for the first wire bend assembly 36), and in each center plate recess 48 (shown in FIGS. 5 and 6 for the second wire bend assembly 38). Extended from the opposite end of each such cylinder 58 is a rod 62 which is capable of being moved into and out of the cylinder. The end of each of the rods 62 is fixedly connected to its respective finger assembly 54.

The above-described arm assembly construction provides each finger assembly with the capability of being moved toward and away from its respective arm assembly. As is described below in greater detail, moving either one or both of the finger assemblies away from their respective arm assemblies during the wire-tying operation takes the slack out of that portion of each of the wires that extends between the finger assemblies so that the wires can be stretched tightly across the top of the bale.

A pneumatic cylinder 64 is connected to each arm 56 to provide for pivoting the arm assemblies 52, and thus the wire bend assemblies 36 and 38, down from their fully raised positions (as shown in FIGS. 1 and 2) to their fully lowered positions.

Figure 7:
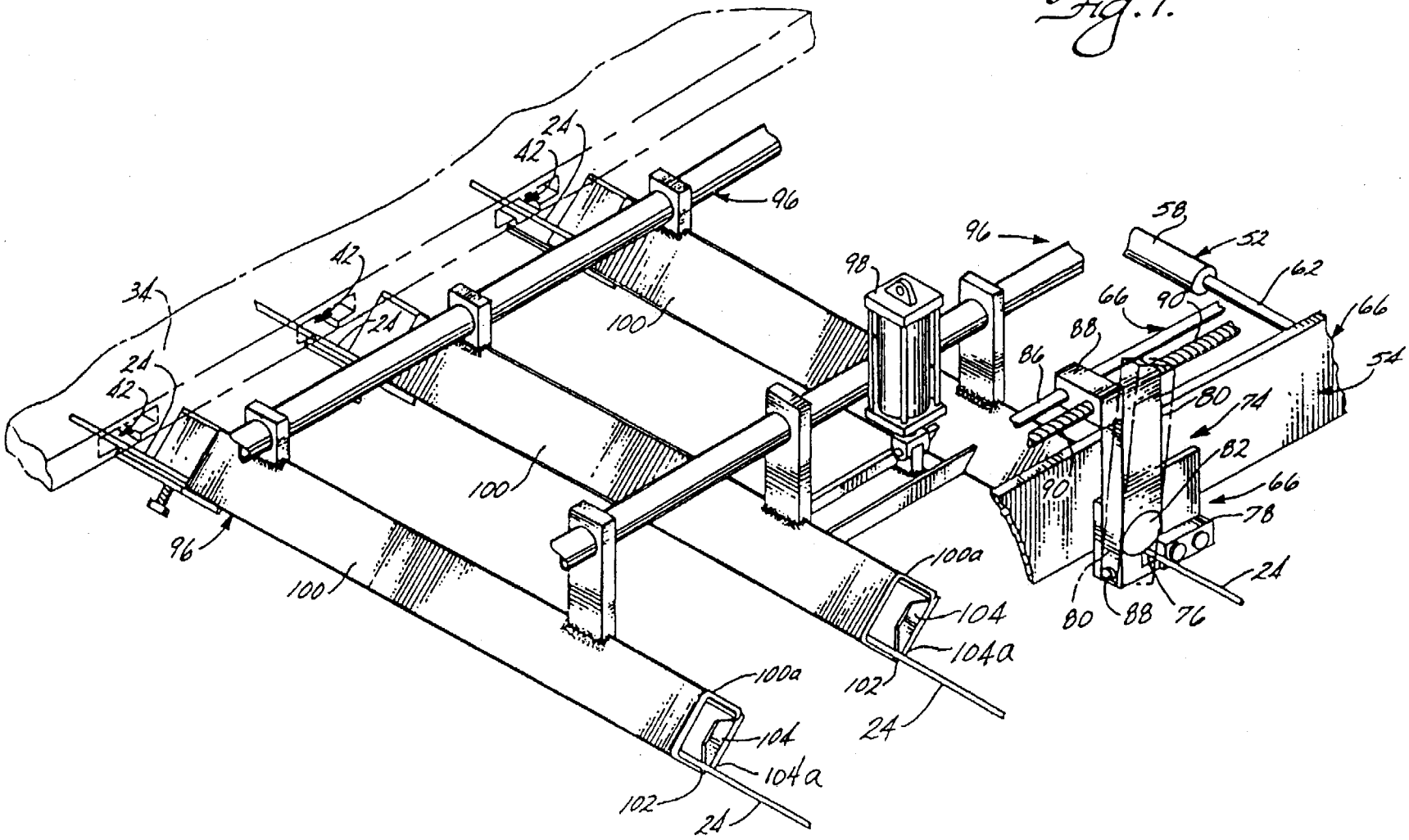
FIG. 7 is a semi-schematic, fragmentary perspective view of a wire-guide tube assembly and a gripper assembly of the wire bend assembly of FIG. 6.

Referring particularly to FIGS. 6 and 7, it can be understood that each finger assembly 54 comprises a gripper structure 66 connected to each of the arm assemblies 52 by means of the cylinder rods 62. In addition to the gripper structure 66, each such finger assembly 54 includes eight elongated fingers 68 (only five of which are shown in FIG. 6, while all eight are shown in FIGS. 1 and 2) horizontally spaced-apart from each other on a rotatably mounted horizontal rod 69 (best seen in FIG. 6 and FIGS. 1 and 2). A pneumatic cylinder 70 is provided on each finger assembly and is connected to the rod 69 by means of a crank 72 (best seen in FIG. 6). As is described in greater detail below, when the pneumatic cylinder 70 is operated, the fingers 68 are pivoted downwardly from their fully raised position extending generally horizontally away from the press (shown in solid lines in FIG. 6 and FIGS. 1 and 2), to their fully lowered position (shown in dashed lines in FIG. 6).

Referring to FIGS. 1 and 2, it can be seen that the operator side finger assembly 54*a* includes eight fingers 68*a*, and the unattended side finger assembly 54*b* includes eight fingers 68*b*. Each of the fingers 68*a* on the finger assembly 54*a* is directly across from a counterpart finger 68*b* on the finger assembly 54*b*. As is described in greater detail below, each finger 68*a* and its counterpart finger 68*b*, i.e., each pair of fingers, operates on the opposed ends of a single wire during the tying operation.

Referring again to FIG. 6, the above-described finger assembly 54 further comprises two stop arms 168 connected on the rotatably mounted horizontal rod 69. The stop arms 168 are connected to the horizontal rod 69 at positions approximately mid way between two bracketing fingers, and are connected to the horizontal rod 69 such that when the pneumatic cylinder 70 is operated, the stop arms 168 are pivoted downwardly, along with the fingers 68, from their fully raised position extending generally horizontally away from the press (as shown in solid lines in FIG. 6), to their fully lowered position (shown in dashed lines in FIG. 6).

A cam arm assembly 170, is connected to the rod 69, in approximately the center of the rod, and further comprises a cam arm 171, connected to the rod 69 at its inside end, and a cam roller 172 connected to the cam arm at the end opposite the horizontal rod 69. The cam roller 172 is connected to the cam arm 171 in a manner such that the roller is free to rotate about its attachment axis on the cam arm 171. As will be described in greater detail below, the stop arms 168 and cam arm assembly 170 cooperate to guide the fingers 68 of the finger assemblies 54 into the correct engagement position into the follow block structure 26, during the last approximately two to three inches of travel of the press ram.

Details of the construction and operation of the gripper structure 66 on both the first and second wire bend assemblies 36 and 38, respectively, can be understood by referring to FIGS. 1, 2, 6, and 7. Each gripper structure comprises eight identical anvil assemblies 74 horizontally spaced apart from each other. One such anvil assembly 74 is associated with one of the fingers 68 and holds one end of each wire 24 firmly therein during the wire-bending operation. As is best seen in FIG. 7, each anvil assembly 74 comprises an anvil 76, an anvil block 78, and an anvil arm 80. Each anvil arm 80 is pivotally mounted on the gripper structure by means of a pivot 82 so that each such arm can be pivoted toward and away from its associated anvil block 78. A pneumatic cylinder 84 (shown in FIGS. 1, 2, and 6) is mounted on the gripper structure 66 of both finger assemblies for providing the pivoting motion to each of the pivot arms 80. The pneumatic cylinder 84 is operably connected to a rod 86 that extends horizontally along the length of the gripper structure. Fixedly connected to the rod 86 in horizontally spaced-apart relationship are eight pivot blocks 88, each of which bears against the top of one of the anvil arms 80. Extending between the top of each anvil arm 80 and the adjacent pivot block 88 which does not act on that particular anvil arm, is a spring assembly 90.

When the pneumatic cylinders 84 on both the front and side back side gripper structures 66 are operated to open the anvil assemblies, i.e., when the cylinders 84 are operated to pivot the bottom portion of each anvil arm away from its respective anvil block, they move both the associated rods 86 and the spring assemblies 90 horizontally to the right, as viewed in FIGS. 6 and 7. Such movement of the rods 86 pushes the pivot blocks 88 against the tops of the anvil arms to thereby pivot the bottoms of the anvil arms away from their associated anvil blocks 78 to open the anvil assemblies. (The anvil arm is shown pivoted to its open position in dashed lines in FIG. 7.)

When it is desired to close the anvil assemblies 74, the pneumatic cylinders 84 are operated to move the rods 86 and the spring assemblies 90 horizontally to the left, as is shown in FIGS. 6 and 7. Such movement of the rods 86 pulls the pivot blocks 88 away from the tops of the anvil arms, thereby allowing the spring assemblies to pivot the bottoms of the anvil arms toward the anvil blocks 78 to close the anvil assemblies. (The anvil arm is shown in its closed position in solid lines in FIG. 7.) The spring assemblies 90 provide sufficient force to hold the anvil assemblies closed so that the wires 24, positioned within the anvil assemblies, are held firmly in place between the end of an adjustable screw 89 (shown in FIG. 7), which extends horizontally through the bottom of each anvil arm to the associated anvil block 78. Since each anvil arm is independently held closed by its associated spring assembly 90, wires that have different diameters, e.g., due to wire manufacturing tolerances, can be accommodated at the same time on the tying device 10 of this invention. If the anvil arms were solidly mounted on the rods 86, for example, only the wire with the largest diameter would be held firmly in the closed anvil assembly, while wires of smaller diameter would be loose.

Referring to FIG. 6, a wire stretch assembly 118 is mounted on the arm assembly 52 of the second wire bend assembly 38 which moves the finger assembly 54 toward and away from its associated arm assembly 52. Movement of the finger assembly 54 away from the arm assembly 52, stretches that portion of each wire 24 that extends between the gripper structures 66 on the first and second wire bend assemblies, when the wires have been secured in the closed anvil assemblies. Although the wire stretch assembly 118 is depicted, in the embodiment illustrated in FIG. 6, as being mounted on the second wire bend assembly 38, an additional wire stretch assembly can be provided on the first wire bend assembly 36, if desired. Alternatively, when only one wire stretch assembly is provided, it can be mounted on the first wire bend assembly 36, instead of the second assembly 38.

The wire stretch assembly 118 includes a pneumatic or hydraulic cylinder 120 that is connected by means of a cylindrical rod 122 and associated linkage 124 to a horizontally extending torque rod or bar 126. Operation of the cylinder 120 causes rotation of the torque rod. A pair of stretch arms 128 is provided, with each arm attached on one end, by an appropriate linkage 130, to the torque rod 126 and on the other end to the finger assembly 54. When the cylinder 120 is operated to move the cylindrical rod 122 out of the cylinder, the torque rod is rotated in a first direction which is translated by the linkage to a linear force which pushes the arms 128 away from the center plate. Motion of the stretch arms 128 moves the finger assembly 54 away from the arm assembly 52 and thus, away from the center plate 34. As the finger assembly is moved away from the center plate 34, the rods 62 comprising each of the cylinder arms 56, slide out of their respective cylinders 58 in response to the motion of the finger assembly. Also, as the finger assembly 54 is moved away from the center plate, the gripper structure 66 of the second wire bend assembly 38 is thereby moved away from the gripper structure 66 of the first wire bend assembly 36. Thus, as is described below in greater detail, during the wire-tying operation, when the wires are being bent around the bale and are held firmly in the closed anvil assemblies, operation of the stretch assembly 118 removes the slack from that portion of each of the wires that extends between the gripper assemblies. Each wire is thus, tightly stretched across the top of the bale 18 and positioned properly for insertion of the opposed ends of the wires into the wire closers.

The operation of the stretch assembly 118 can be adjusted to provide a desired amount of stretch to the wires. In a working environment, the stretch assembly 118 can be adjusted to move the gripper assemblies farther apart from between about 1½ to about 3½ inches. If desired, less than 1½ inches or more than 3½inches of stretch can be provided.

Means are provided on both the first and second wire bend assemblies 36 and 38, respectively, for guiding the wires 24 into proper position in the tying device 10 during the wire-loading operation. The wire guide means comprises a first guide tube assembly 94 on the first wire bend assembly 36 (shown in FIG. 1) and a second wire guide assembly 96 on the second wire bend assembly 38 (shown in FIG. 2 ).

Referring to FIG. 7, there is shown a portion of the second guide tube assembly 96, which is identical to the first guide tube assembly 94 with the exception that the assembly 96 includes a pneumatic lift cylinder 98 for lifting the second guide tube assembly while the first guide tube assembly does not include such a cylinder. As is described below in greater detail, the lift cylinder 98 enables the wires to be loaded into the wire-tying device and engaged in the gripper structure anvil assemblies on the unattended side of the press without a workman having to be present on that side.

The construction of both the guide tube assembly 94 on the operator side of the press and the guide tube assembly 96 on the unattended side of the press can be understood by referring to FIG. 7. Each of the guide tube assemblies 94 and 96 comprises eight interconnected, horizontally spaced-apart, hollow guide tubes 100 (only three of which are shown in FIG. 7), wherein each such guide tube is open at both ends. Each guide tube 100 is associated with one of the fingers 68 on its respective wire bend assembly. Additionally, each guide tube 100 is aligned in a direction about parallel to its associated finger 68 when the finger is in its fully raised position. A slot 102 is provided through the bottom of each guide tube along its length so that the wires 24 inserted through the guide tubes can exit the tubes during the tying operation. A spring-mounted flap 104 is mounted on the distal end 100*a* of each such tube and whose bottom side 104*a* extends across the slot 102 in the bottom of the tube. The spring pressure of the flaps 104 biases the flap bottoms 104*a* against the tubes, thus closing off the slots 102 and maintaining the wires 24 in the tubes during the wire-loading operation and during a first portion of the wire-tying operation. The flaps are forced away from the tubes by the wires when the wire pressure becomes greater than the spring tension to thereby open the slots 102 and allow the wires to exit the guide tubes (i.e., after the wires are tied around the bale).

Additional details of construction of the guide tubes and their operation is described below with regard to the operation of the wire-tying device.

Figure 8:
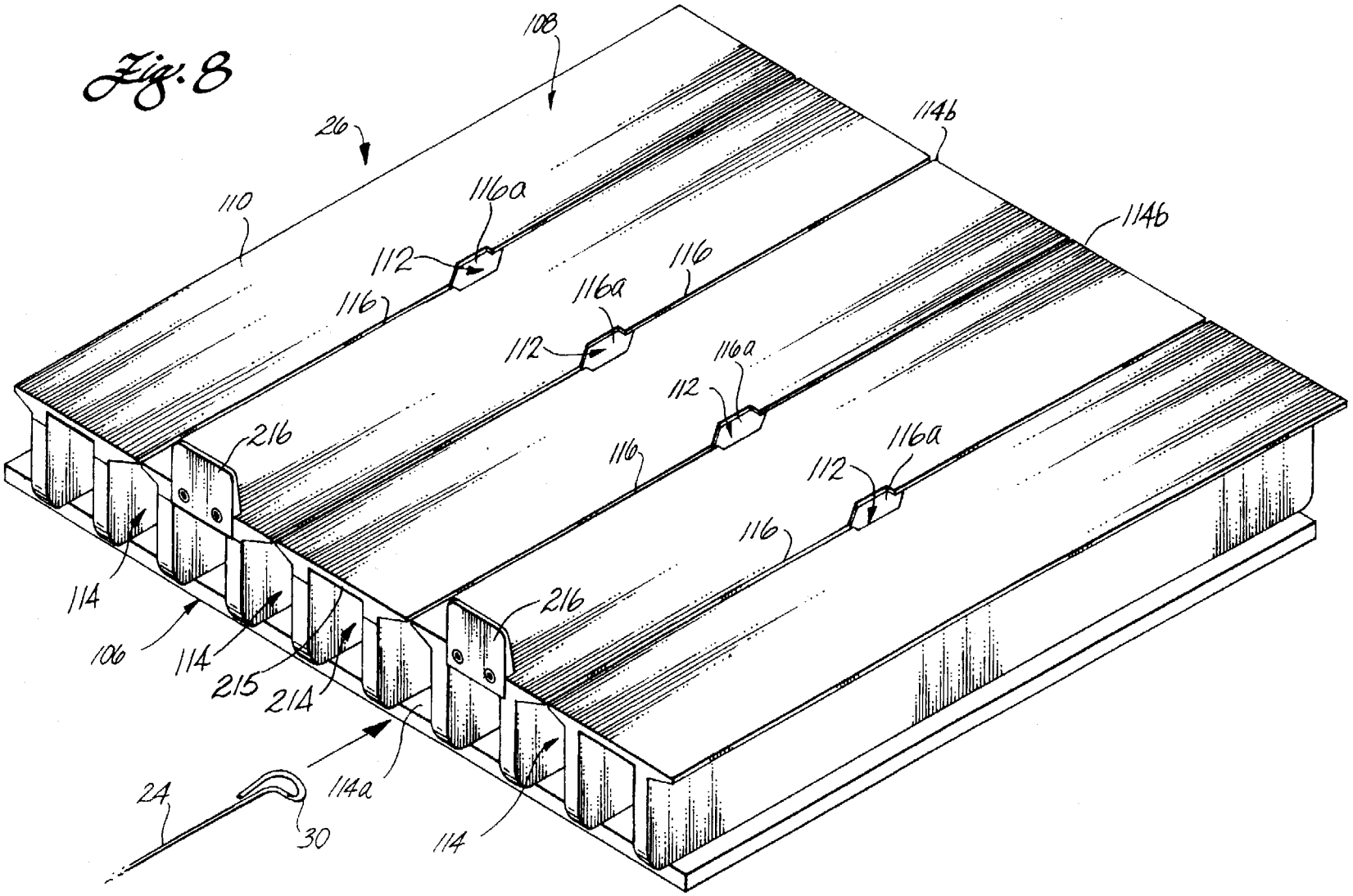
FIG. 8 is an enlarged, fragmentary perspective view of the follow block of the wire-tying device of FIGS. 1 and 2.

Referring to FIGS. 1, 2, and 8, the follow block structure 26 comprises a base 106 and a wire closer assembly 108 mounted on the base. The top surface 110 of the wire closer assembly 108 forms the floor of the baling chamber 20 in which the bale 18 (shown only in FIGS. 1 and 2) is formed. The bale 18 is carried on the wire closer and is compressed against the surface 110 when the press ram 22 is raised. The closer assembly 108 comprises a plurality of horizontally spaced-apart, identical wire closer structures or closers 112. In this instance, since the wire-tying device 10 of the illustrated embodiment is designed to tie eight wires 24 around the bale 18, eight wire closers 112 make up the closer assembly 108 (four such wire closers 112 are shown in FIG. 8). Each wire closer 112 includes a cavity 114 open at both ends for insertion of the opposed pre-formed interlocking ends 30 and 32 of one of the wires as such a wire is bent around the bale by the operation of the wire bend assemblies 36 and 38. For example, as best seen in FIG. 8, the first pre-formed end 30 of each wire 24 is inserted into the open end 114*a* of the wire closer cavity 114, and the second pre-formed end 32 of each wire 24 is inserted into the opposite open end 114*b* of the cavity 114. Means described below in greater detail are provided in each wire closer cavity for joining the pre-formed interlocking ends of the wires together as such opposed ends are inserted into the cavity and moved into engagement with each other.

A slot 116 (best seen in FIGS. 2 and 8) extends horizontally across the top surface 110 of each wire closer 112 and opens into its cavity 114. The slots 116 are provided for removal of the wires 24 after the wires are tied around the bale. An enlarged area 116*a* of each slot 116 is provided for removal of the knot formed by the interlocking ends of the wires after they are joined together.

In addition to the wire closer cavities 114, a guide cavity 214 is provided in approximately the center of the follow block structure, sandwiched between two wire closer cavities. The guide cavity 214 is open at both ends for insertion of the opposed cam arm assemblies 170 (best seen in FIGS. 1, 2 and 6) as the wire bend assemblies 36 and 38 are bent around the bale. As will be described in greater detail below, the top interior surface of the guide cavity 214 is constructed with a leading bevel 215 which engages the cam roller 172 when the cam arm assembly 170 begins the insertion process into the open end of the guide cavity 214.

As seen in FIG. 8, the follow block structure 26 further includes two stop blocks 216, which are positioned between two wire closer cavities 114 and extend vertically for a distance of approximately one inch above the top surface 110 of the wire closer assembly 108. The stop blocks 216 are located at a position that would intersect the arc of travel of the stop arms 168, if the wire bend assemblies 36 and 38 were to operate and attempt to insert the fingers 68 into their corresponding wire closer cavities 114, when the follow block structure 26 was not raised to a sufficiently high position to permit entry. When this is the case, the stop blocks 216 interpose themselves in the travel arc of the stop arms 168, preventing the stop arms from travelling further and, thus, preventing the wire bend assemblies from being lowered in to an improper position.

Additional interior details of construction of the wire closers 112 are described below in relation to the operation of the wire-tying device 10.

Loading and Automatic Tying Operation

Loading of the wires 24 onto the wire-tying device 10 in the operation of the device for automatically tying the wires around the bale 18 can be understood by referring particularly to FIGS. 4 and 9–17.

Referring first to FIG. 4, a control circuit that is shown schematically at 132 is provided to control the tying device 10 during manual loading and automatic tying operations. The control panel of the control circuit 132 is mounted on the operator's side of the press.

During the time that the bale 18 is being formed in the baling chamber 20 and the press doors are closed, the wires 24 are loaded or positioned on the device 10 for tying by a single workman stationed on the operator's side of the press. To load each such wire 24 onto the device 10, the workman pushes the second pre-formed end 32 of the wire through one of the guide tubes 100 on the first guide tube assembly 94, through the associated cavity 42 in the center plate 34, and thence through the associated guide tube 100 (shown in its lower position in dashed lines in FIG. 4) on the second wire guide assembly 96. This procedure is repeated for loading all 8 wires 24 onto the device. At this time, the first pre-formed end 30 of each wire 24 (as shown in dashed lines in FIG. 4) extends out from the guide tube 100 of the first wire guide assembly 94 to a position below its associated operator side finger 68*a* and below the now open anvil assembly in which it is to be held. In similar fashion, the second pre-formed end 32 of each wire 24 (as shown in dashed lines in FIG. 4) extends from the guide tube 100 of the second guide tube assembly 96 to a position below its associated finger 68*b*.

Figure 18:
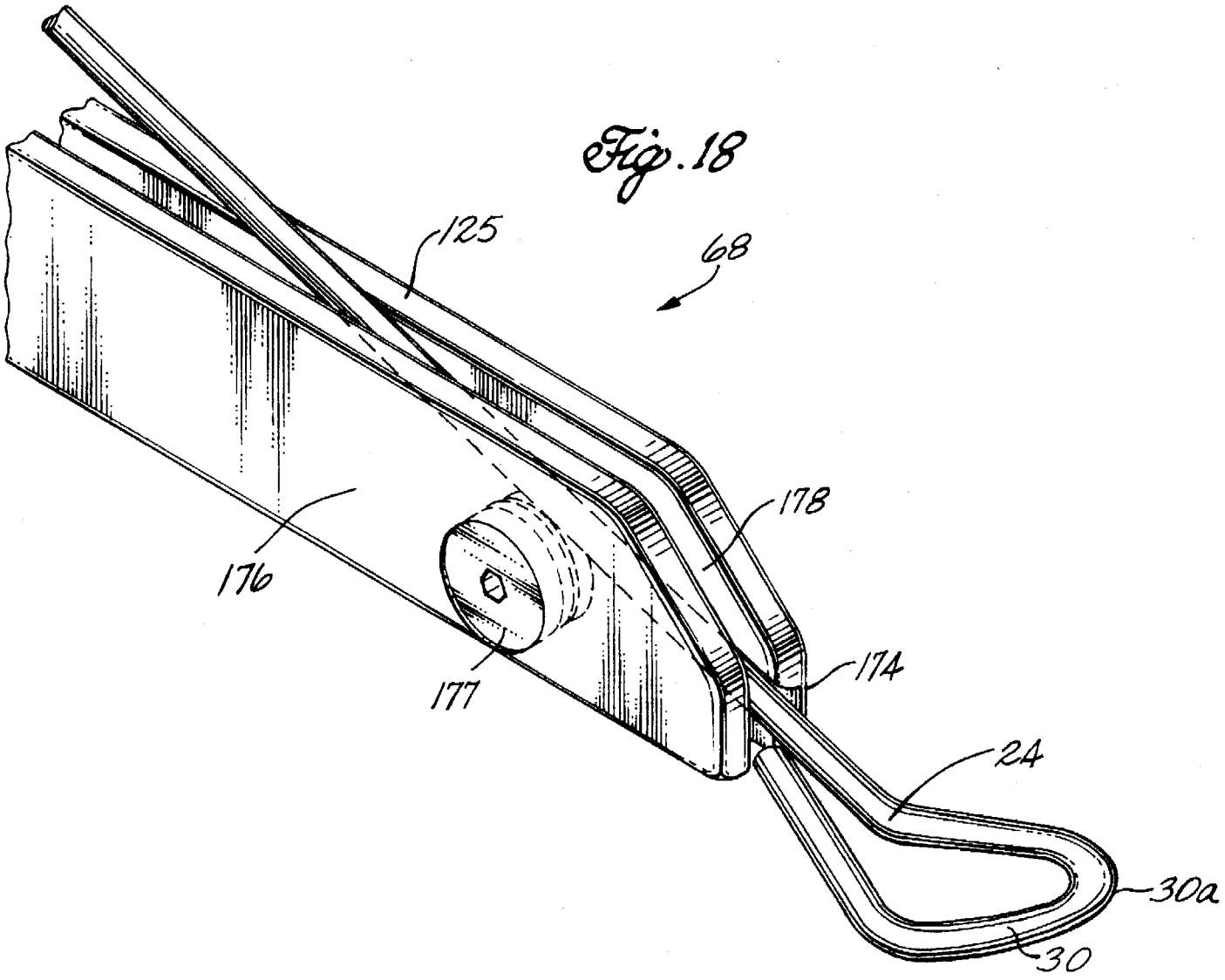
FIG. 18 is an enlarged, semi-schematic, fragmentary perspective view of one of the fingers on the operator side of the wire-tying device with a wire engaged in the finger.

Referring now to FIG. 18, in addition to FIG. 4, the operator places the first ends 30 of each of the wires 24 in a notch 174 in the end of each of the fingers 68*a*. As is shown more clearly in FIG. 18, each finger 68*a* is constructed from two metal cheek plates 175 and 176 which are spaced apart by a spacer assembly 177 in order to form a slot 178 between the two cheek plates, into which the shaft of the wire 24 is disposed. The slot 178 is provided so that the pre-formed end 30 of each wire 24 can slide along the slot, over the spacer assembly 177, and out of the end of the finger as the wire is bent during the tying operation.

A notch 174 is cut into one of the cheek plates 175 in its distal end, i.e., the notch 174 is on the end of the finger 68*a*. The slot 178, defined by the cheek plates 175 and 176, is constructed with a tall aspect ratio such that the slot 178 is substantially deeper than it is wide. The slot 178 has sufficient width, defined by the spacer assembly 177, to hold a wire therein, but because the loop diameter is greater than the width of the slot 178, the loop may only be inserted in the slot 178 when the loop in the wire first end 30 is oriented in a vertical plane. the slot width is sufficiently narrow to prevent the wire 24 from rotating once the loop in the first end 30 is positioned between the plates 175 and 176. Since the first end loop 30 of the wire 24 is bent at an obtuse angle to the major axis of the wire, the loop bears against that plate 175 towards which the loop bend is directed. Once the loop is positioned within the slot, and oriented vertically, the first end 30 is snapped into the notch 174, which engages the first end 30 and holds the wire in place.

As is described below in greater detail, the ends 30 of the wire must extend a sufficient distance from the distal ends of the fingers 68 so that the wires can be properly positioned and joined together in the wire closers. Since the wires 24 are placed in proper position by their insertion into the notch 174 in the distal end of the finger on the operator side, no such notch is required, and none is provided, on the fingers of the bend assembly 38 on the unattended side of the press.

As is best illustrated in FIG. 4, by the operation of lifting the wires 24 into the slots 178 and engaging the ends 30 of the wire into the notch 174, the wires are moved up (as shown in solid lines in FIG. 4) and held in position in the open anvil assemblies on the operator's side of the press.

To position the opposite ends of the wires 24 in the open anvil assemblies on the unattended side of the press, the workman pushes a button on the control circuit panel to thereby operate the pneumatic cylinder 98 on the second guide tube assembly 96. Such remote operation of the cylinder 98 lifts the guide tubes 100 of the second guide tube assembly 96 from a first relatively lower position (shown in dashed lines in FIG. 4) to a second relatively higher position (shown in solid lines in FIG. 4). When the guide tubes are in their lower position, the wires 24 (shown in dashed lines in FIG. 4) extend from the ends of the tubes 100 beneath the respective anvil assemblies and associated fingers 68*b*. When the guide tubes are moved to their raised position by the operation of the cylinder 98, they lift the wires 24 (shown in solid lines in FIG. 4) into the open anvil assemblies on the finger assembly 68*b*.

About one second after the button is pushed, to raise the second guide tube assembly 96 and thus, after all the wires 24 are properly positioned in the open anvil assemblies, the control circuit automatically operates the pneumatic gripper structure cylinders (84 of FIG. 6) on both the first and second wire bend assemblies 36 and 38. Operation of the cylinders 84 closes the anvil assemblies in the manner described above so that the wires are now held securely in place for tying.

After the above-described manual and semi-automatic wire loading operations have been completed, and the wires are secured in the anvil assemblies, the tying device is said to be in its "fully loaded" condition. As is described below in greater detail, once the tying device is in its fully loaded condition, the remainder of the bale-tying operation is controlled automatically by operation of the control circuit 132.

After the tying device is loaded, and when the press ram 22 reaches a pre-determined position, but while it is still moving to compress a bale and before it reaches its fully raised position, the press doors are opened (as shown in FIGS. 1 and 2) so that the bale 18 is exposed in the baling chamber 20 for tying. The press doors, when fully opened, operate a limit switch in the control circuit 132, which in turn starts the automatic sequencing of the bale-tying operation. Alternatively, the press doors may be automatically opened and the automatic sequencing of the bale-tying operation may be started when the press ram reaches a pre-determined position which, in turn, operates the limit switch in the control circuit 132.

Figure 9:
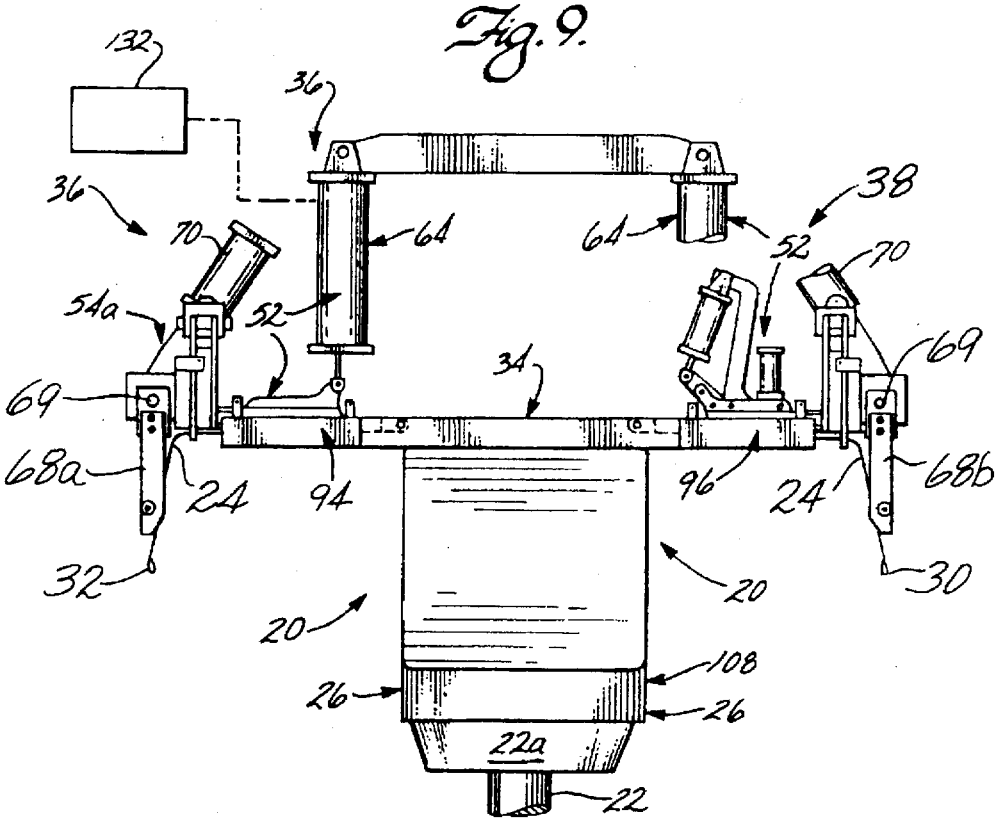
FIG. 9 is a semi-schematic, fragmentary end view of the wire-tying device of FIGS. 1 and 2, at a first stage in the wire-tying operation with the wire bend assembly fingers in their fully lowered position.

Referring now to FIG. 9, the control circuit 132 automatically initiates the tying sequence by first operating pneumatic cylinders 70 on both the first and second wire bend assemblies 36 and 38, to thereby rotate the rod 69 associated with the finger assemblies 54*a* and 54*b* by about 90°. Rotation of the rod 69 pivots the finger 68*a* on the first finger assembly 54*a* and the finger 68*b* on the second finger assembly 54*b* from their fully raised position (as shown in FIG. 4) to their fully lowered position (as shown in FIG. 9). Such pivoting movement of the fingers bends the ends of each of the wires 24 by about 90° around the anvil 76 of the closed anvil assemblies in which they are held.

As is best seen in FIG. 9, since the pivot point of the fingers, i.e., the rods 69, are closer to the ends of each of the wires 24 than are the anvils around which the wires are bent, the first pre-formed ends 30 of the wires slide out of the ends of the fingers 68*a* as the wires are bent by the fingers. In a working embodiment of the wire-tying device 10, the first pre-formed ends 30 of each of the wires 24 extend about 4 inches out of the front of the fingers 68*a* after the 90° bend is made. The second preformed ends 32 of the wires 24 also slide away from the tips of the fingers 68*b*. Therefore, after the fingers have been pivoted from their fully raised to their fully lowered positions, the ends 30 and 32 are a desired distance from their associated fingers so that they may be properly positioned in the wire closers.

Figure 10:
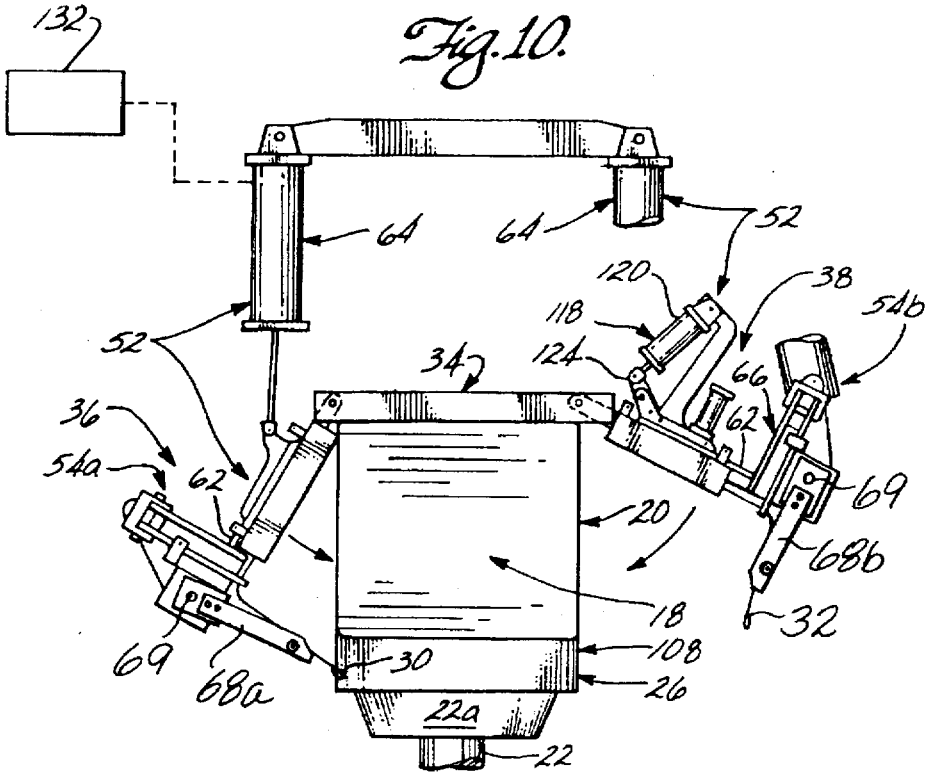
FIG. 10 is a semi-schematic, fragmentary end view of the wire-tying device of FIG. 9 at a second stage in the wire-tying operation after both the front and back sidearm assemblies have started pivoting from their fully raised to their fully lowered positions.

Referring now to FIG. 10, after a time delay of sufficient length to allow the fingers to arrive at their fully lowered positions, the control circuit automatically operates the pneumatic cylinders 64 on the first wire bend assembly 36 to start the first assembly pivoting downwardly from its fully raised to its fully lowered position. The first wire bend assembly operates to bend the first pre-formed ends 30 of the wires 24 downwardly around the operator's side of the bale 18. After an additional time delay, the control circuit automatically operates the pneumatic cylinders 64 on the second wire bend assembly 38 to start the second wire bend assembly pivoting downwardly from its fully raised to its fully lowered position. The second wire bend assembly operates to bend the second pre-form ends 32 of the wires 24 downwardly around the opposite side of the bale.

A time delay is provided in the control circuit 132 to automatically operate the pneumatic stretch cylinder 120 of the wire stretch assembly 118 after the first and second wire bend assemblies begin pivoting down. As is described above, operation of the stretch cylinder 118 through the linkage 124 rotates the torque tube 126 (not shown on FIG. 10) to thereby move the gripper structure 66 on the second wire bend assembly 38 away from the center plate 34 to thereby take up the slack in that portion of the wires that extends between the gripper assemblies. The wire bend assembly 38 is shown in FIG. 10 after the wire stretch assembly 118 has operated to stretch the wires tightly across the top of the bale.

In accordance with practice of principles of the invention, the tying device 10 includes means which enable the first and second wire bend assemblies 36 and 38 to operate so as to tie wires around the bale during the final approximately two to three inches of press ram travel. The tying device 10 is, thus, able to tie the bale during the compression operation, thus, resulting in a considerable savings of time. Means are also provided to prevent the first and second wire bend assemblies 36 and 38 from being pivoted to their fully lowered positions unless and until the press ram has been raised to, at least, a predetermined vertical position, such that the fingers, and their associated wires, are free to enter their respective closer cavities. The construction and operation of such means are described with respect to the initial orientation of the wire tying device as depicted in FIG. 10 and the cross-sectional views through various sections of the follow block as depicted in FIGS. 11, 12 and 13.

Figure 11:
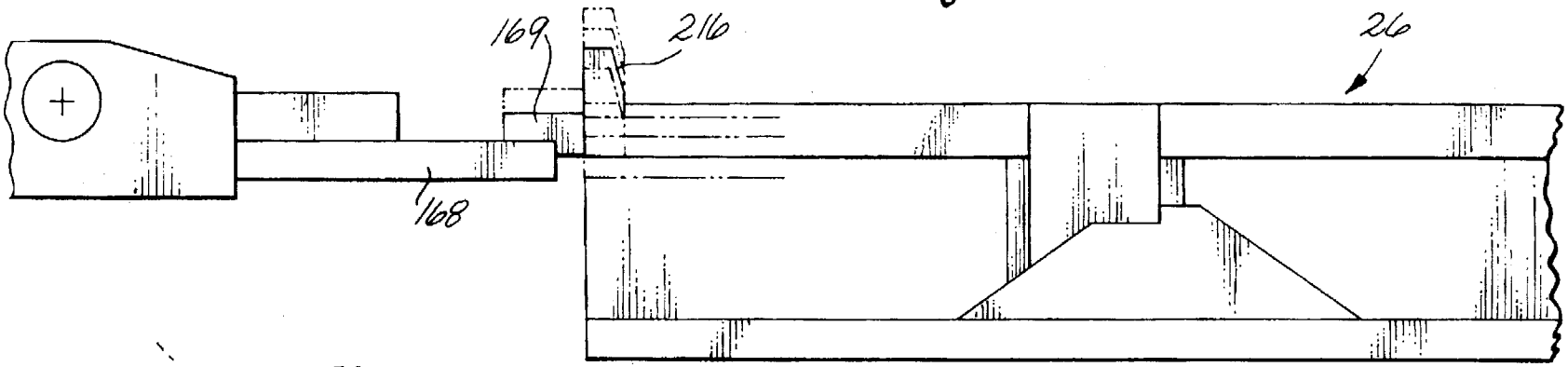
FIG. 11 is a semi-schematic, fragmentary, cross sectional view of a stop arm contacting a stop block as the follow block is raised in order to compress a bale.

Referring now to FIGS. 10, 11, 12 and 13, as the first wire bend assembly 36 pivots downwardly (as shown in FIG. 10) from its fully raised towards its fully lowered position, the stop arm 168 (shown in FIGS. 11 and 13), connected to the wire bend assembly 36, is thereby swung, in an arcuate fashion, to an angular position where it makes contact (as shown in FIG. 11) with a stop block 216, provided for such purpose on the follow block 26. The stop arm 168 includes a bumper 169, which presses against the stop block 216 if the press ram has not raised the follow block 26 to a sufficient vertical position to allow the stop arm to enter its attendant cavity below the stop block. The stop arm 168 is prevented from being pivoted to its fully lowered position by the stop block 216. Since the stop arm 168 is connected to the first wire bend assembly 36, the stop arm 168, in turn, prevents the first wire bend assembly 36 from pivoting the fingers 68 into their fully lowered positions with the wires 24 inserted into their respective closer cavities 114. The stop arm 168 and stop block 216, in combination, thus provides means for preventing the wire bend assemblies from being placed in their fully lowered positions prematurely and the wires at the end of the fingers from being forced into the sides of the follow block, thus catastrophically bending, or even breaking the wires.

The pressure of pneumatic cylinder 64 on the first wire bend assembly 36 maintains the stop arm 168, and bumper 169 against the stop block 216, which is shown, in phantom, moving upward against the bumper 169, as the press ram continues to compress the bale. This pressure continues until the stop block 216 is raised past the travel arc of the stop arm 168 and bumper 169, which allows the stop arm 168 to, then, enter its associated cavity in the follow block 26.

Figure 12:
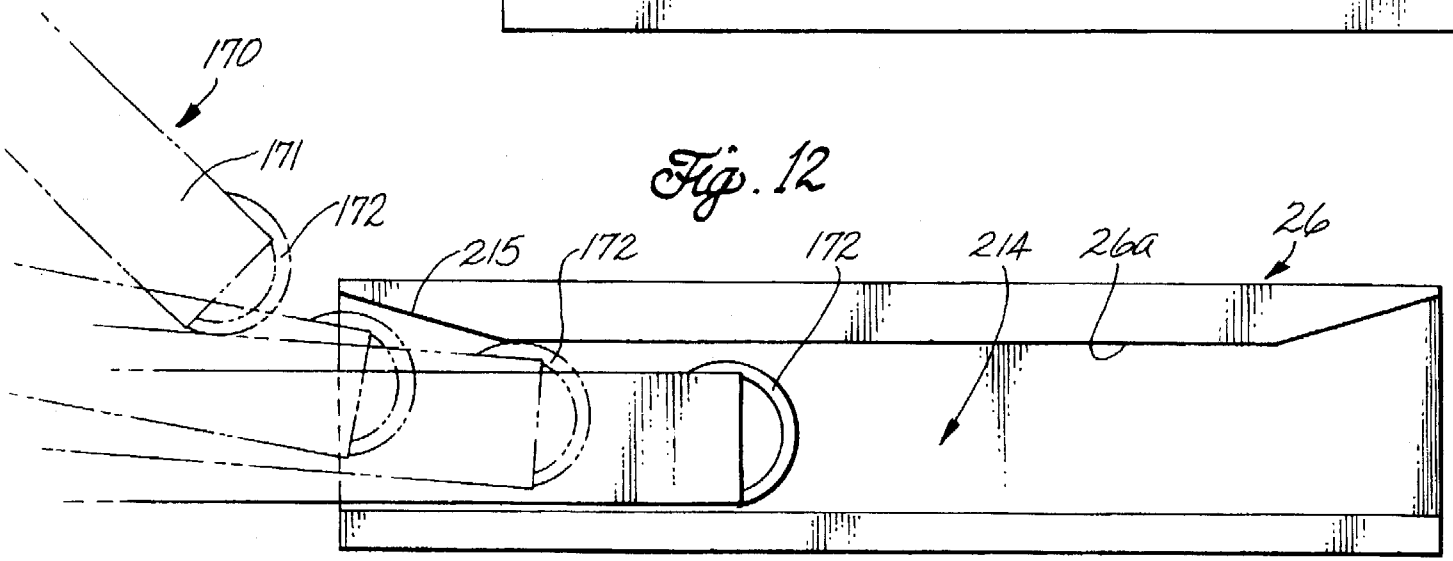
FIG. 12 is a semi-schematic, fragmentary, cross sectional view of the travel motion of a cam arm assembly as a wire bend assembly is pivoted to its fully lowered position.
Figure 13:
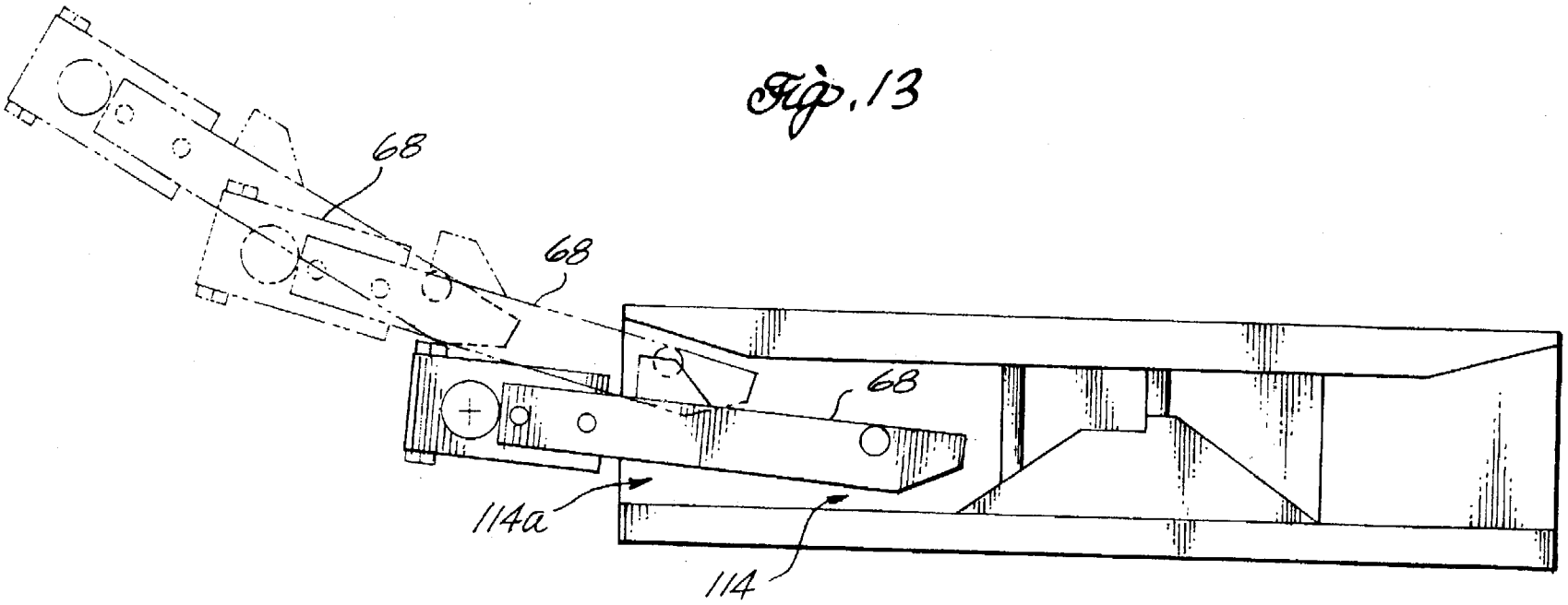
FIG. 13 is a semi-schematic, cross sectional view of a finger assembly as it is guided into a closer cavity by action of the cam arm assembly.

Referring now to FIGS. 12 and 13, the fingers 68 are guided into proper position in their respective closer cavities 114 by the cam arm assembly 170, after the movement of the follow block clears the stop block from contact with the stop arm. Once the stop arm 168 is free to enter its associated cavity, the cam arm assembly 170, its motion previously suspended by the stop arm 168, is now also free to move into its own associated guide cavity 214 by virtue of its connection, with the stop arm 168, to the wire bend assembly 36. As the cam arm assembly 170 (FIG. 12) begins to enter the guide cavity 214, the roller 172, at the distal end thereof, engages a bevel 215 provided at the leading edge of the top surface of the guide cavity.

As the roller 172 is moved along the bevel 215, the cam arm 171, to which the roller 172 is attached, is forced downward, into a more acute angle to the follow block assembly 26. As the cam arm 171 is forced downward, the cam arm, in turn, applies a torque to arm 69 (shown in FIG. 10) of the wire bend assembly 36 which, in turn, forces the fingers 68, attached thereto, into the same acute angle with respect to the follow block assembly 26. This motion deflects the tips of the fingers 68 into the center of the opening 114A (as seen in FIG. 13), thereby guiding the fingers 68 into their associated closer cavity 114 in a manner so as to avoid a collision between the fingers, and the wires carried by the fingers, with the exterior structure of the follow block.

Returning to FIG. 12, as the press ram continues to compress the bale, and the follow block structure 26 continues to move upwardly in response to pressure from the press ram, the cam roller 172 is continually biased against the upper surface 26*a* of its associated cavity by the geometry of the cam arm assembly 170. The angular position of the cam arm assembly 170, thereby, controls the angular position of the fingers 68 as they travel along the closer cavity 114. The angular position of the finger 68 ensures that their associated wires 24 are suspended in the correct position in the closer cavity 114 for eventual engagement with the wires of the second wire bend assembly 38, in a manner to be described more fully below.

The sequence of insertion of the interlocking ends of the wires, into the wire closers, the manner in which the wires are joined together in the closers, and additional details of construction of the closers can be best understood by referring to FIGS. 8 and 14–16.

Figure 14:
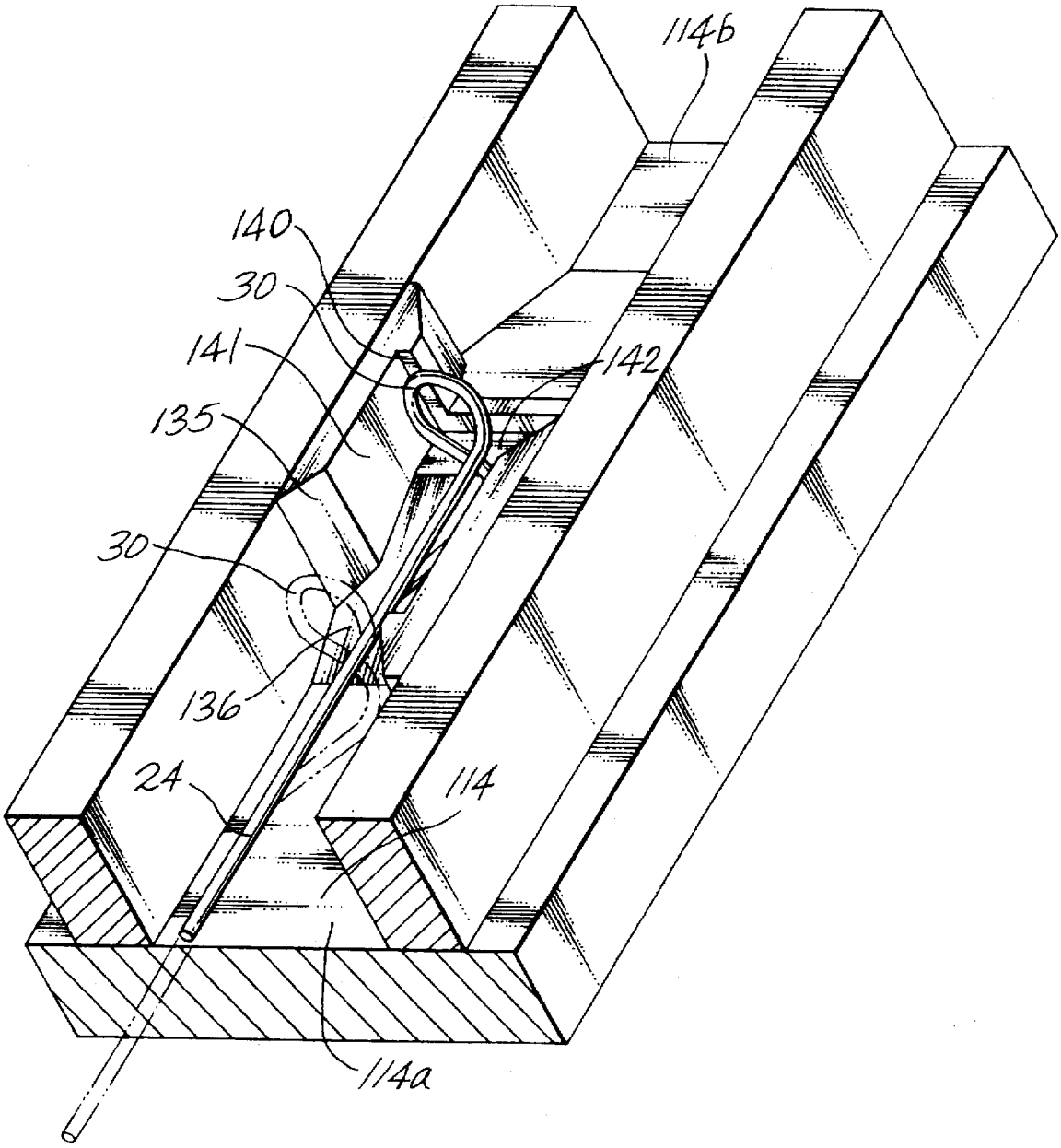
FIG. 14 is a semi-schematic, enlarged perspective, fragmentary view of a wire closer of the wire-tying device of FIGS. 1 and 2 illustrating an early stage of the sequence of joining the pre-formed interlocking ends of one of the wires together in the closer.

Referring first to FIGS. 8 and 14, due to the above-described pre-programmed automatic sequencing of the arm assemblies, the first interlocking end or loop 30 of each wire 24 enters the end 114*a* of the cavity 114 of its respective closer 112 before the second interlocking end 32 (not shown in FIG. 14) enters the end 114*b*. As the loop 30 of the wire 24 (shown in phantom lines in FIG. 14), passes through the cavity 114, the tip of the loop 30 (which is oriented in the vertical plane and which plane is bent towards the cavity side) contacts, and is guided along, a bevel 135, which extends horizontally into the cavity 114 in the direction of the loop plane. The loop is biased against the bevel 135 by the mechanical spring pressure of the wire 24, and thus the path and the lateral position of the loop 30 is determined by the bevel 135. Loop 30 of the wire 24 is pushed up a wire closer ramp 136 in the cavity 114 as the first bend assembly 36 continues to pivot toward its fully lowered position. The tip of the loop 30 is then guided to rest against a stop 140 by an interior wall surface 141 against which the loop tip slides as the loop is pushed forward into the closer cavity.

The loop 30 of each such wire 24 is held securely against movement back and forth against the stop 140 by the first wire bend assembly 36 when it is in its fully lowered position. The loops 30 are restricted from moving up or down by pressure from the bottom surface, 142, of the closer structure. The surface extends vertically into the closer cavity 114, so as to define a generally narrow throated pocket in which the wire loops' freedom of motion is restricted. When the loops 30 of the wires (as shown in solid lines in FIG. 14) are in position, the loops are ready to be engaged and joined together with the ends or loops 32 of the second ends of the wire.

Figure 15:
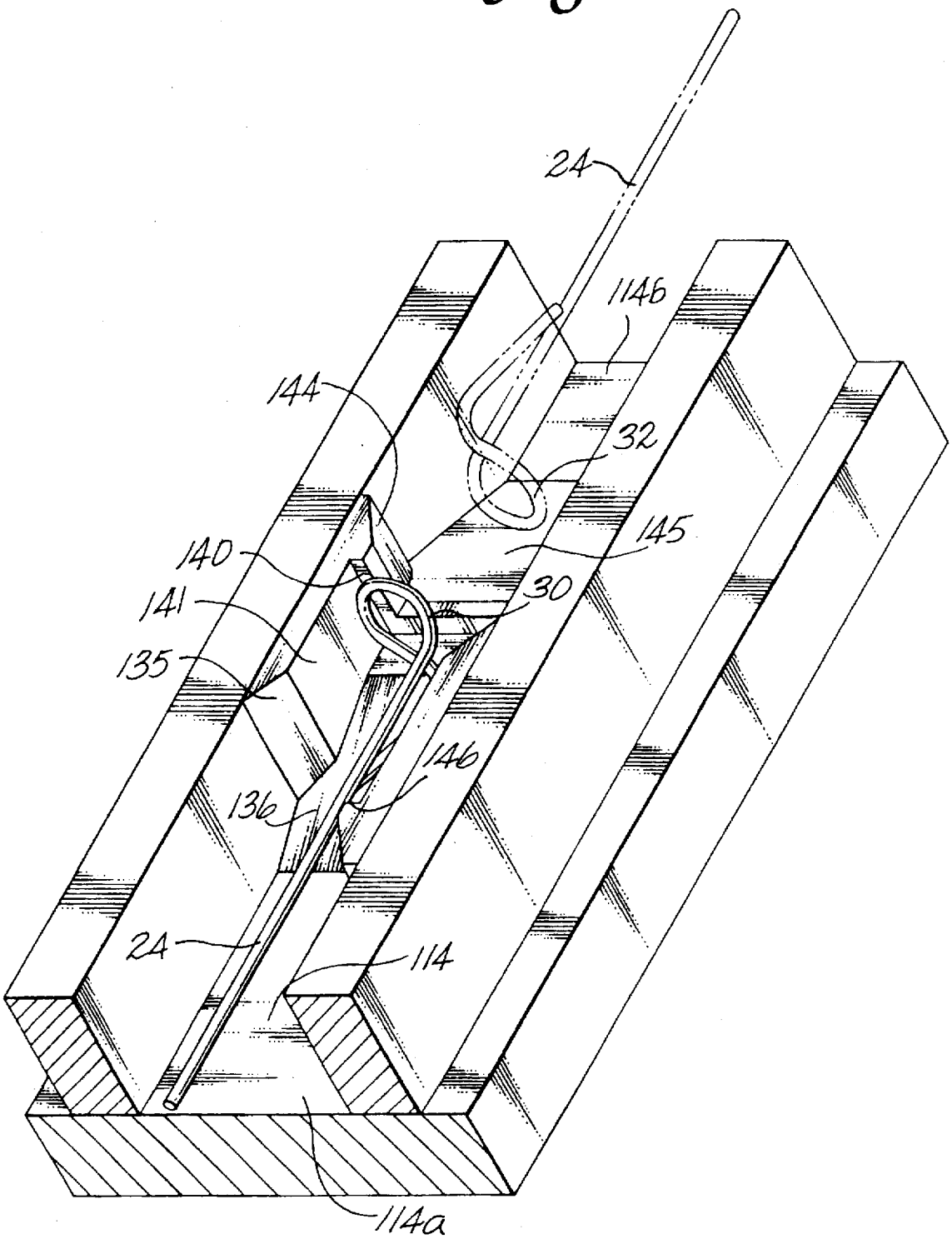
FIG. 15 is a semi-schematic, enlarged perspective, fragmentary view of the wire closer of FIG. 11 illustrating a later stage of the sequence of joining the pre-formed interlocking ends of one of the wires together in the closer.

Referring next to FIG. 15, the loop 30 of the wire 24 is positioned in the closer assembly, as described above with reference to FIG. 14, while a second end or loop 32 of the wire 24 enters the end 1143 of the wire closer cavity 114 and is pushed into the cavity 114 by the second bend assembly 38 as it moves toward its fully lowered position. The loop 32 is biased into proper alignment for mating with the loop 30 by a second bevel 144 provided at the opposite leading edge of the interior wall surface 141 from the first bevel 135. The loop 32 is biased against the bevel 144 because of the positioning of the fingers 68 in the closer cavity 114 by action of the cam arm 170. The loop 32 is pushed up a second wire closer ramp 145, as the second bend assembly 38 pivots towards its fully lowered position, until the tip of the loop abuts a second stop 146.

Because the loops 30 and 32 are oriented in a substantially vertical plane, the combination of bevels 135 and 144, ramps 136 and 145, and stops 140 and 146, function to guide the loops into proper position for interlocking, and hold the loops in place, against vertical or lateral movement, once the interlocking ends have engaged one another. The vertical orientation of the loops allows the wires and loops to be biased into proper position by, for example, the bevels 135 and 144, without the torquing and other misalignment problems associated with free-floating horizontally oriented loops.

Figure 16:
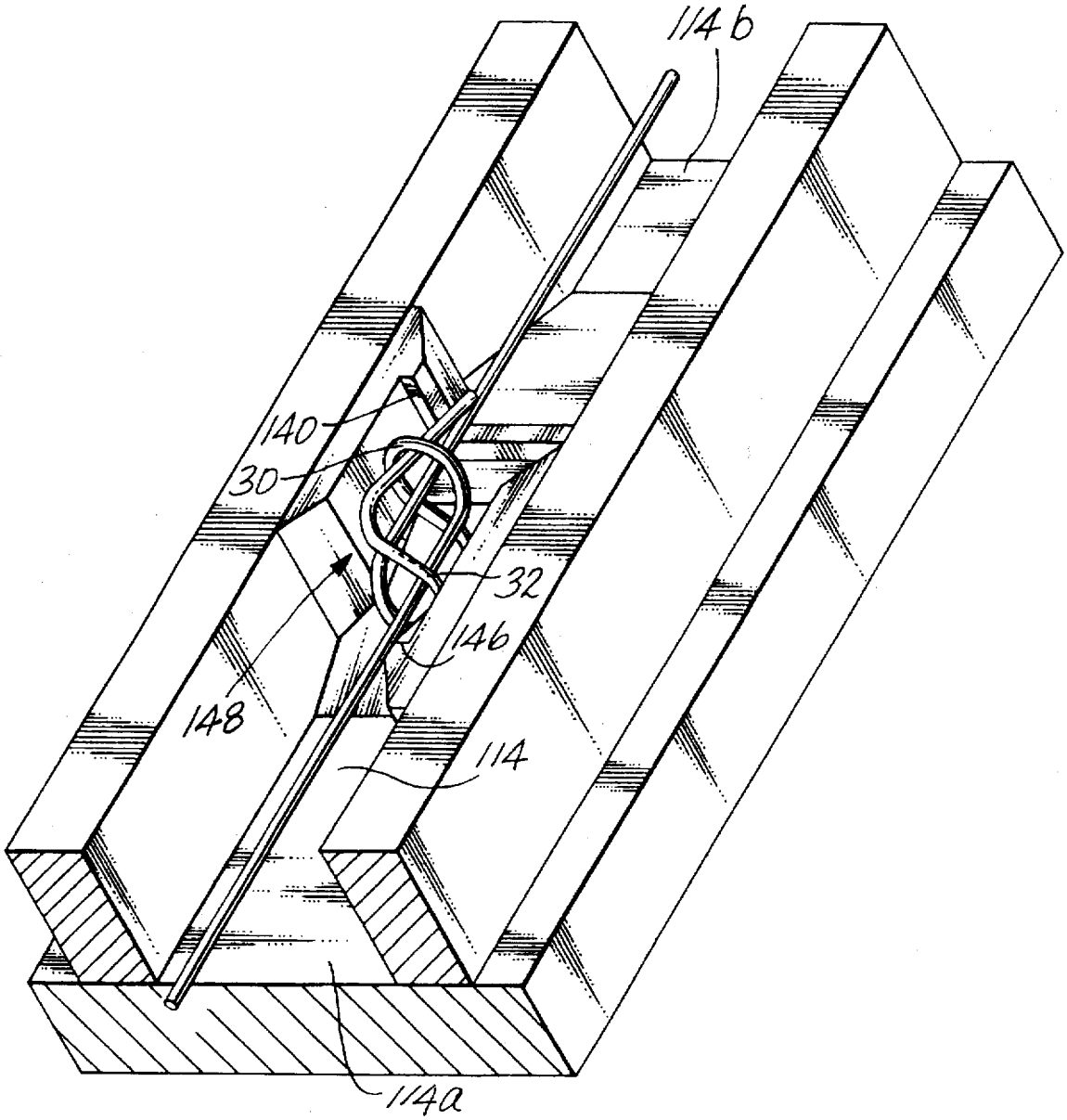
FIG. 16 is a semi-schematic, enlarged perspective, fragmentary view of the wire closer of FIG. 13 illustrating the final stage of the sequence of joining the pre-formed interlocking ends of one of the wires together in the closer.

As can be seen in FIG. 16, the loop 32 of the wire 24 engages the loop 30 after the loop 32 has been pushed past the loop 30 by the second arm assembly 38. When the second arm assembly 38 is in its fully lowered position, the loop 32 is adjacent the second stop 146. Likewise, when the first arm assembly 36 is in its fully lowered position, the loop 30 is adjacent its corresponding stop 140.

Figure 17:
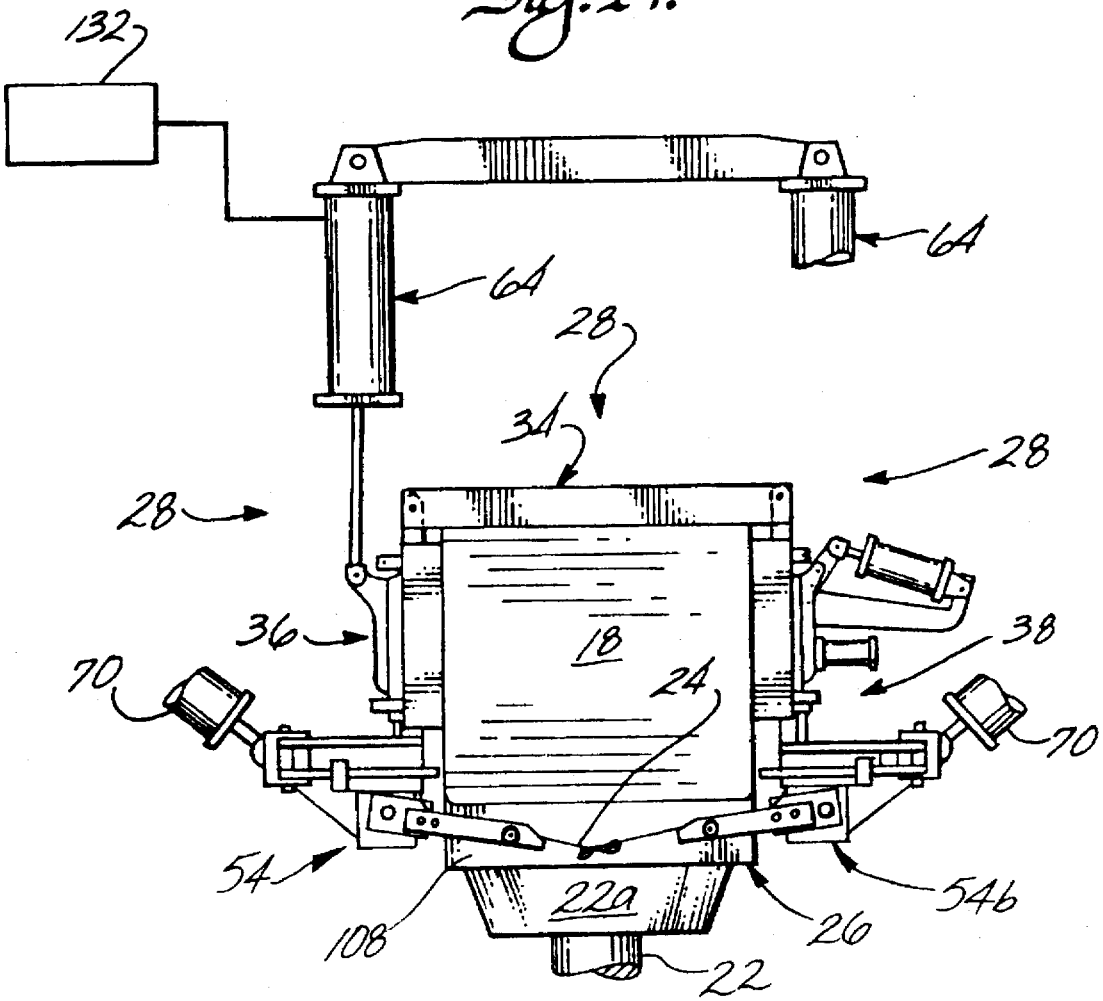
FIG. 17 is a semi-schematic, fragmentary end view of the wire-tying device of FIG. 10 at a third stage in the wire-tying operation after both the front and back sidearm assemblies have been pivoted to their fully lowered positions, and the wire ends have been engaged.

When the first and second ends 30 and 32 of the wires 24 are engaged, as shown in FIG. 16, and the second bend assembly 38 has reached its fully lowered position (as is shown in FIG. 17), the control circuit automatically operates the pneumatic gripper assembly cylinders 84 (as shown in FIG. 6) on both the finger assemblies, by means of a limit switch (not shown). As best shown in FIG. 6, operation of the pneumatic cylinders 84 opens all of the anvil assemblies 74 and releases the wires 24 from the wire bend assemblies 36, 38. Although the wires are released from the wire bend assemblies when the anvil assemblies are opened, so long as the bend assemblies are in their fully lowered position, the wires are held in the position shown in FIG. 15.

After a selected time delay provided by the control circuit 132 (FIG. 10) that begins when the anvil assemblies are opened, the control circuit automatically operates the pneumatic cylinder 64 (FIG. 10) on the wire bend assembly 36 (FIG. 10) to start pivoting the assembly 36 from its fully lowered position to its fully raised position. As the assembly 36 begins moving upwards, it disengages the wires 24 to allow the loops 30 and 32 to spring back from their positions against the stops 140 and 146 and move in a direction toward the closer cavity openings 114*a* and 114*b*. Such movement continues until the ends 30 and 32 form a tight knot indicated generally at 148 (best seen in FIG. 16), which is stopped from further movement out of the cavity 114 by the stops 140 and 146. The knot 148 is, thereby, positioned and securely held directly below the enlarged portion 116*a* of the slot 116 so that the wire and knot formed therein can exit the closer cavity 114 through the slot.

In the reverse of the process described above, as the first bend assembly is being pivoted back up to its fully raised position, and after the knot has been formed, the control circuit operates to begin pivoting the second wire bend assembly back from its fully lowered position to its fully raised position. After the first and second assemblies have reached their fully raised positions, the control circuit automatically operates the pneumatic cylinders on both finger assemblies, and the pneumatic stretch cylinder of the stretch assembly, to return the fingers to their fully raised position and to return the finger assembly on the second wire bend assembly to its unstretched position.

The workmen then lowers the press ram which releases the compression on the bale, thereby allowing the bale to expand within the wires which now tightly encircle the tied bale.

When both the first and second bend assemblies and have returned to their fully raised positions with the fingers up, and the stretch assembly has repositioned the second assembly to its unstretched configuration, the tying device is ready to be loaded with another set of wires for tying the next bale.

After the assemblies 36 and 38 have been returned to their fully raised position, as described in the preceding paragraph, the tied bale 18 is removed from the press, and the press doors are closed so that the wire loading and tying sequence can be repeated for the next bale.

The above description of a preferred embodiment of the wire tying device 10, provided in accordance with this invention, and its automatic operation, is for illustrative purposes. Because of variations, which will be apparent to those skilled in the art, the present invention is not intended to be limited to the embodiment described above. The scope of the invention is described in the following claims.

What is claimed is:

1. A tying device for mounting on a baling press for tying wire having pre-formed interlocking ends around a bale formed in the press, the tying device comprising:

(a) a first wire bend assembly pivotally mounted on one side of the baling press for holding and bending the first pre-formed interlocking end of a wire downwardly around one side of the bale as the assembly pivots from its fully raised to its fully lowered position;

(b) a second wire bend assembly pivotally mounted on the opposite side of the baling press for holding and bending the second pre-formed interlocking end of the wire downwardly around the opposite side of the bale as the assembly pivots from its fully raised to its fully lowered position;

(c) a movable follow block mounted on the press having a top surface which forms the floor of the chamber in which the bale is formed, the follow block moving against the bale in order to compress the bale in the chamber;

(d) a wire closer, wherein the first interlocking end of the wire is held by the first wire bend assembly as the second interlocking end of the wire is moved by the second wire bend assembly into interlocking engagement with the first end; and (e) guide means for guiding the first interlocking end of the wire into position in the wire closer and for guiding the second interlocking end of the wire into interlocking engagement with the first end, the guide means guiding the first and second interlocking ends into interlocking engagement while the follow block is still moving to compress the bale, the guide means further comprising means for preventing the first and second wire bend assemblies from pivoting to the fully lowered position unless the follow block has been raised to a predetermined position.

2. A tying device in accordance with claim 1 wherein the wire closer comprises an elongated, open-ended cavity extending across the width of the closer, the first pre-formed interlocking end of the wire being inserted into the first open end of the cavity by the first wire bend assembly as the first assembly is pivoted downwardly, and the second interlocking end of the wire being inserted into a second open end of the cavity by the second wire bend assembly as the second assembly is pivoted downwardly.

3. A tying device in accordance with claim 2 wherein the open-ended cavity comprises:

(a) first and second sides and a bottom; and (b) wherein each side comprises a substantially vertical shoulder for restricting the motion of a loop.

4. A tying device in accordance with claim 3 wherein the wire closer further comprises a stop for placing a knot formed by the interlocking ends of the wire in proper position for removal from said wire closer.

5. A tying device in accordance with claim 1 wherein at least one of the wire bend assemblies comprises means for stretching the wire tightly across the top of the bale.

6. A tying device in accordance with claim 1 wherein each such wire bend assembly comprises means for placing about a 90° bend in the wire adjacent both the first and second interlocking ends.

7. A tying device in accordance with claim 1 wherein each of the pre-formed interlocking ends comprises a loop formed in the wire, the loop defining a plane, and wherein the wire closer is adapted to receive the pre-formed interlocking ends with the loop plane in a substantially vertical orientation.

8. A tying device for mounting on a baling press for tying a plurality of wires with pre-formed interlocking ends around a bale being formed in the press, the tying device comprising:

a center plate mounted on the baling press having a bottom surface which comprises the roof of a chamber in which the bale is formed and against which the bale is compressed;

a first wire bend assembly pivotally mounted on one side of the center plate for holding and bending a first pre-formed interlocking end of a wire downwardly around one side of the bale as the assembly pivots from its fully raised to its fully lowered position;

a second wire bend assembly pivotally mounted on the opposite side of the center plate for holding and bending a second pre-formed interlocking end of the wire downwardly around the opposite side of the bale as the assembly pivots from its fully raised to its fully lowered position;

a wire closer assembly mounted on the press having a top surface which forms the floor of the chamber in which the bale is formed and which is movable in a direction toward the center plate so as to compress the bale, the wire closer assembly comprising a plurality of horizontally spaced wire closers, each of which comprises means for joining the opposed ends of each wire together as such a wire is bent around the bale; and wherein the first and second wire bend assemblies pivot from their fully raised to their fully lowered positions, thereby joining the opposed ends of each wire together while the top surface of the wire closer assembly is in motion toward the center plate and the bale is still being compressed.

9. A tying device in accordance with claim 8 wherein each wire bend assembly comprises:

an arm assembly mounted on the center plate capable of being pivoted downwardly from a fully raised position to a fully lowered position; and a finger assembly mounted on the arm assembly, the finger assembly comprising a plurality of horizontally spaced-apart fingers each of which can be pivoted downwardly from a fully raised position to a fully lowered position, each such finger on the first wire bend assembly being associated with a counterpart finger on the second wire bend assembly, the wire bend assembly is constructed so that when both the arm assemblies and fingers comprising the first and second wire bend assemblies are in their fully raised positions, and the wires to be tied around the bale are positioned in the tying devices for tying, each such wire is held on one end by one of the fingers of the first wire bend assembly and extends across the baling press such that the second end of such wire is underneath the counterpart finger of the second wire bend assembly.

10. A tying device in accordance with claim 9, each of said plurality of horizontally spaced wire closers comprising a cavity open on both ends for insertion in the opposite ends of the wires, each such wire closer further comprising means for holding the first interlocking end of such a wire in proper position therein so that when the second pre-formed interlocking end of such a wire is inserted into the wire closer, such interlocking ends are joined together.

11. A tying device in accordance with claim 9 wherein said finger assemblies each further comprise guide means for guiding the first interlocking end of the wire into position in the wire closer cavity and for guiding the second interlocking end of the wire into interlocking engagement with the first end, the guide means operatively responsive to the motion of the wire closer assembly as it moves toward the center plate, thereby compressing the bale.

12. A tying device in accordance with claim 11 wherein the guide means comprises a cam arm assembly coupled to the finger assembly and operatively controlling the angular position of the finger assembly, the cam arm assembly including a cam roller for engaging the wire closer assembly the cam roller entering a corresponding cavity in the wire closer assembly, thereby guiding the finger assembly fingers into the open ends of their corresponding cavities.

13. A tying device in accordance with claim 12, the guide means further comprising a stop arm coupled to the finger assembly, the stop arm including a bumper for contacting the wire closer assembly when the wire closer assembly has not moved sufficiently toward the center plate so as to allow the finger assembly fingers to be inserted into the open ends of the wire closer cavities, the stop arm thereby preventing the wire bend assemblies from being pivoted to their fully lowered position.

14. A tying device in accordance with claim 13, the wire closer assembly further comprising a follow block, the follow block top surface forming the floor of the chamber in which the bale is formed and against which the bale is compressed, the follow block including at least one stop block positioned to be interposed in the direction of motion of the stop arm when the wire closer assembly has not moved sufficiently toward the center plate during compression of a bale.

* * * * *